US009009877B2

(12) United States Patent
Miwa et al.

(10) Patent No.: US 9,009,877 B2
(45) Date of Patent: Apr. 21, 2015

(54) DRAIN DUCT AIR SUCTION DEVICE FOR FLUSH TOILET

(75) Inventors: Koji Miwa, Tokyo (JP); Kojiro Watari, Tokyo (JP); Hitomi Yamai, Tokyo (JP); Ken Higuchi, Tokyo (JP)

(73) Assignee: Lixil Corporation, Tokyo (JP)

( * ) Notice: Subject to any disclaimer, the term of this patent is extended or adjusted under 35 U.S.C. 154(b) by 340 days.

(21) Appl. No.: 13/503,456

(22) PCT Filed: Nov. 4, 2010

(86) PCT No.: PCT/JP2010/069596

§ 371 (c)(1),
(2), (4) Date: Apr. 23, 2012

(87) PCT Pub. No.: WO2011/055745

PCT Pub. Date: May 12, 2011

(65) Prior Publication Data

US 2012/0210506 A1 Aug. 23, 2012

(30) Foreign Application Priority Data

Nov. 6, 2009 (JP) ..... 2009-255367
Nov. 10, 2009 (JP) ..... 2009-256666
Sep. 28, 2010 (JP) ..... 2010-217123

(51) Int. Cl.
*E03D 1/06* (2006.01)
*E03D 11/02* (2006.01)
*E03D 11/08* (2006.01)

(52) U.S. Cl.
CPC ..... *E03D 11/02* (2013.01); *E03D 11/08* (2013.01); *E03D 2201/30* (2013.01)

(58) Field of Classification Search
USPC ..... 4/434, 344, 364, 368–370, 420, 421, 4/423, 431, 328
See application file for complete search history.

(56) References Cited

U.S. PATENT DOCUMENTS 255,485 A * 3/1882 Boyle ..... 4/328
291,139 A * 1/1884 Boyle ..... 4/328

(Continued)

FOREIGN PATENT DOCUMENTS

CN 101233281 7/2008
EP 1 990 473 11/2011

(Continued)

OTHER PUBLICATIONS

English Translation of the Written Opinion of the Internation Searching Authority.*

(Continued)

*Primary Examiner* — Paul R Durand
*Assistant Examiner* — Erin Deery
(74) *Attorney, Agent, or Firm* — Smith, Gambrell & Russell, LLP

(57) ABSTRACT

Air suction device for a flush toilet configured to suction air from a toilet drain duct having a suction chamber dividing a tank body interior, a float in the suction chamber and an on-off valve closing an air inlet when the float lifts to prevent air flow from the toilet drain duct side into the suction chamber. The air inlet is higher than the water level in a toilet flushing standby mode. The on-off valve opens the air inlet to allow air flow form the drain duct side in the suction chamber when flush water in the tank drops such that the float is lowered form the raised position. An embodiment includes a valve chest, a float and attracting member for on-off valve manipulation. Another embodiment includes a valve chest with a small air flow manipulation hole.

20 Claims, 25 Drawing Sheets

(56) References Cited

U.S. PATENT DOCUMENTS

| | | | | | |
|---|---|---|---|---|---|
| RE11,351 | E | * | 7/1893 | Boyle | 4/328 |
| 575,111 | A | * | 1/1897 | Harvey | 4/328 |
| 5,694,652 | A | * | 12/1997 | Stock et al. | 4/328 |
| 7,594,282 | B2 | * | 9/2009 | Shirai | 4/328 |
| 8,141,179 | B2 | * | 3/2012 | Hennessy | 4/328 |
| 8,196,231 | B2 | * | 6/2012 | Hennessy | 4/328 |
| 8,266,732 | B1 | * | 9/2012 | Wang et al. | 4/368 |
| 8,468,616 | B2 | * | 6/2013 | Song et al. | 4/431 |
| 8,595,868 | B2 | * | 12/2013 | Fukagawa et al. | 4/421 |
| 2009/0151063 | A1 | | 6/2009 | Shirai et al. | |
| 2010/0212696 | A1 | | 8/2010 | Shirai et al. | |
| 2012/0174307 | A1 | * | 7/2012 | Wang | 4/370 |

FOREIGN PATENT DOCUMENTS

| | | |
|---|---|---|
| JP | 5-57080 | 7/1993 |
| JP | 7-42217 | 2/1995 |
| JP | 2007-63980 | 3/2007 |
| JP | 2007-255069 | 10/2007 |

OTHER PUBLICATIONS

Machine Translation of JP05-57080.*

International Search Report for PCT/JP2010/069596 mailed Dec. 14, 2010 (in English).

* cited by examiner

DRAIN DUCT AIR SUCTION DEVICE FOR FLUSH TOILET

TECHNICAL FIELD

The present invention relates to an air suction device.

BACKGROUND ART

Patent Document 1 discloses a conventional flush tank device. The flush tank device includes a tank body, a water supply device and an air suction device which sucks air in a toilet drain duct. The tank body has a drain outlet which is capable of being opened and closed by an on-off valve and of storing flush water used to flush a toilet body. The drain outlet of the tank body communicates with the toilet body having a toilet bowl and the toilet drain duct communicating with a downstream side of the toilet bowl. The water supply device supplies flush water into the tank body. The air suction device is disposed in the tank body and comprises a booth having a closed upper end and an open lower end and an air suction duct provided in the booth and extending over an uppermost water level in the tank body. The air suction duct communicates with the toilet drain duct.

In this flush tank device, when the on-off valve of the drain outlet is opened so that toilet flushing is started, the flush water stored in the tank body flows through the drain outlet into the toilet body. As a result, a water level of the flush water stored in the tank body lowers. In this case, air in the toilet drain duct is sucked through the air suction duct into the booth of the air suction device such that the flush water level lowers. More specifically, the air suction device sucks air in the toilet drain duct according to lowering of the flush water level in the booth. The air suction device sucks air in the toilet drain duct at the time of toilet flushing, whereby a siphon action is reliably caused in the toilet drain duct, with the result that the siphon action can be facilitated.

PRIOR ART DOCUMENT

Patent Documents

Patent Document 1: Japanese Patent Application Publication No. JP-A-H07-42217

SUMMARY OF THE INVENTION

Problem to Be Overcome By the Invention

In the above-described conventional flush tank device, however, the flush water level in the booth lowers substantially at a constant rate while a predetermined amount of flush water flows from the drain outlet of the tank body into the toilet body after the start of toilet flushing and the on-off valve of the drain outlet closes. More specifically, the air suction device starts sucking air in the toilet drain duct simultaneously with start of toilet flushing. Accordingly, the air suction device sucks air in the toilet drain duct before the flush water having flowed out of the tank body further flows into the toilet drain duct. In order that the siphon action may be caused in the toilet drain duct, a predetermined amount of flush water needs to flow into the toilet drain duct and a predetermined flow rate of flush water needs to flow into the toilet drain duct. Even when air in the toilet drain duct is sucked therebefore, the suction does not contribute to causing the siphon action.

The present invention was made in view of the above-described circumstances of the conventional art and a problem to be solved by the invention is to provide an air suction device which can perform a favorable toilet flushing.

Means for Overcoming the Problem

An air suction device for a flush toilet according to the invention features an air suction device that can operate relative to a tank body storing flush water used to flush a toilet body having a toilet bowl and a toilet drain duct communicating with a downstream side of the toilet bowl and a water supply device supplying flush water into the tank body. The air suction device is configured to suction air from the toilet drain duct, the air suction device comprises a suction chamber formed as to divide an interior of the tank body and extending in an up-down direction and having a lower end that has an opening for communicating with the interior of the tank body. The air suction device further includes a float member disposed in the suction chamber and having a set buoyancy, an on-off valve that closes an air inlet when the float member is raised to a predetermined raised position, thereby preventing air flow from a toilet drain duct side into the suction chamber. The air inlet is located higher than a water level in a toilet flushing standby mode and provides communication between the suction chamber and the toilet drain duct side, the on-off valve opens the air inlet so as to allow air to flow from the toilet drain duct side into the suction chamber when the flush water in the tank body outside the suction chamber drops to or below a set water level such that the float member is lowered from the raised position.

The air inlet is opened when the water level in the interior of the tank body outside the suction chamber drops to or below the set water level. Thus, a time lag can be provided between start of toilet flushing and the opening of the air inlet. Accordingly, at the time of the opening of the air inlet, a predetermined amount of flush water flows in the toilet drain duct as the result of flow of flush water from the tank body into the toilet body, and the flush water flows into the toilet drain duct at a predetermined flow rate. Consequently, when the air suction device sucks air in the toilet drain duct, a siphon action can reliably be caused in the toilet drain duct.

Furthermore, since the air inlet is located higher than the water level in the toilet flushing standby mode, air in the toilet drain duct can sufficiently be sucked by making the most use of changes in the water level of flush water in the suction chamber. Consequently, the siphon action can reliably be caused in the toilet drain duct.

Accordingly, the air suction device according to the invention can perform a desirable toilet flushing.

The air suction device may include a float member disposed in the suction chamber and having a set buoyancy. In this case, the on-off valve closes the air inlet thereby to prevent air flow from the toilet drain duct side into the suction chamber when the float member is raised to a predetermined raised position, and the on-off valve opens the air inlet to allow air to flow from the toilet drain duct side into the suction chamber when a water level in the tank body outside the suction chamber drops to or below a set water level such that the float member descends from the raised position.

In this case, the air inlet is closed by the on-off valve at the time of start of toilet flushing. When the flush water stored in the tank body is discharged so that toilet flushing starts, the water level in the interior of the tank body outside the suction chamber starts to drop. Since the air inlet is closed by the on-off valve, outside air is prevented from flowing into the suction chamber until the water level in the interior of the tank body outside the suction chamber drops to the predetermined water level. Accordingly, the water level of the flush water in the suction chamber remains unchanged until the water level in the interior of the tank body outside the suction chamber drops to the predetermined water level. When the water level in the interior of the tank body outside the suction chamber drops to or below the predetermined water level, the negative pressure produced in the suction chamber becomes larger than the buoyancy of the float member, whereupon the float member descends from the raised position. Since the on-off valve is lowered with descent of the float member, the air inlet is opened. There is a large difference in the water level between the interior of the suction chamber and the interior of the tank body outside the suction chamber at the time of the opening of the air inlet.

This difference in the water level results in sudden drop of the water level in the suction chamber. As a result, the air suction device can swiftly suck air in the toilet drain duct. Thus, the flush tank device can swiftly suck air in the toilet drain duct without increase in size of the air suction device.

The on-off valve may have a shaft which is reciprocally moved in the vertical direction while being inserted through the air inlet, and a first valve element connected to a lower end of the shaft and abutting on a peripheral edge of the air inlet. The float member may be formed independent of the on-off valve and, when raised, may abut an upper end thereof on a lower end of the on-off valve thereby to raise the on-off valve.

In this case, since the float member is formed independent of the on-off valve, the on-off valve can be raised in the vertical direction irrespective of the ascending posture of the float member and accordingly, the air inlet can reliably be closed by the first valve element of the on-off valve.

The float member may have a protrusion formed by upwardly convexing the central upper end thereof and the on-off valve may have a recess which is formed by upwardly concaving the central lower end thereof and on which the protrusion abuts.

In this case, the buoyancy of the float member can be transmitted to the central part of the on-off valve since the central upper end of the float member is upwardly convexed into the protrusion and the central lower end of the on-off valve is upwardly concaved into the recess. Furthermore, the on-off valve can be raised by a strong force since the buoyancy of the float member is concentrated on the distal end of the protrusion. Consequently, the first valve element can reliably close the air inlet.

The air inlet may have a guide path extending vertically upward. The shaft of the on-off valve may be formed to be longer than the guide path and guided by the guide path so as to be reciprocally moved in the vertical direction, and the on-off valve may have a second valve element which is connected to an upper end of the shaft and abuts on a peripheral edge of an upper end opening of the guide path when the float member descends below a set descent position, thereby preventing air from flowing from the toilet drain duct side into the suction chamber.

In this case, when the float member is caused to descend below the set descent position during flow of flush water in the tank body into the toilet body in the second half of toilet flushing, the second valve element abuts on the peripheral edge of the upper end opening of the guide path thereby to prevent air flow from a communication passage side into the suction chamber. More specifically, the air suction from the toilet drain duct by the air suction device can be terminated in the second half of toilet flushing. As a result, the flush water can be prevented from being rendered insufficient in the toilet drain duct due to the air suction device sucking air in the toilet drain duct while the flow rate of flush water flowing from the tank body into the toilet body is reducing, and accordingly, the siphon action can be prevented from being terminated too early. This can continue the siphon action and reliably discharge floating sewage or the like to the downstream of the toilet drain duct.

Furthermore, when the tank body is drained in a cold weather region, the on-off valve is moved downward and the second valve element abuts on the peripheral edge of the upper end opening of the guide path thereby to prevent air flow from the communication passage side into the suction chamber, since the float member is located below the set descent position. More specifically, odor can be prevented from reverse flowing from the toilet drain duct side.

The air suction device may further comprise a guide member provided in the suction chamber and housing the float member so that the float member is reciprocally moved in the vertical direction, the guide member having an upper opening formed in an upper end thereof and a lower opening formed in a lower end thereof, and a float valve element provided in the lower opening of the guide member so as to ascend thereby to close the lower opening of the guide member when a water level in the suction chamber is raised from below the lower end of the guide member.

In this case, when flush water is supplied from the water supply device into the tank body such that the water level in the suction chamber rises, the float valve element closes the lower opening of the guide member. Accordingly, the flush water does not flow from the lower opening into the guide member, whereupon the float member does not ascend. As a result, since the air inlet is not closed by the on-off valve, the flush water can be caused to flow into the interior of the suction chamber outside the guide member. When the water level rises in the interior of the suction chamber outside the guide member such the flush water flows from the upper opening of the guide member into the guide member, the float member ascends with the result that the air inlet is closed by the on-off valve. Thus, delay in ascent of the float member can render the suction chamber substantially full of flush water until the air inlet is closed by the on-off valve. This can realize desirable air suction from the toilet drain duct by the suction device in subsequent toilet flushing.

The air suction device may include a valve chest which is formed so as to extend upward from a peripheral edge of the air inlet and communicates via an air suction path with the toilet drain duct, the valve chest housing the on-off valve, a float member disposed in the tank body outside the suction chamber into which the flush water is supplied directly from the water supply device, the float member descending when the flush water is at or below a set water level lower than the water level in the toilet flushing standby mode, and a holding portion moved upward and downward along the valve chest in conjunction with ascent and descent of the float member, the holding portion holding an attracting member which attracts the on-off valve or vice versa when a distance therebetween is within a set range, thereby opening the air inlet.

In this case, the air inlet is closed by the valve element at the time of start of toilet flushing. When the outlet of the tank body is opened by the on-off valve and toilet flushing starts, the flush water stored in the tank body flows through the outlet into the toilet body, with the result the water level in the interior of the tank body outside the suction chamber starts to descend. On the other hand, since the air inlet is closed by the valve element, the water level in the suction chamber remains maximum. Thereafter, the float member starts to descend when the water level in the interior of the tank body outside the suction chamber drops to or below the set water level. The holding portion holding the attracting member is also moved downward with descent of the float member. The attracting member moved downward with the holding portion and the valve element attract each other when the valve element comes near the attracting member within the set range. As a result, the valve element leaves the air inlet such that the air inlet is opened. Since air is prevented from flowing into the suction chamber until the air inlet is opened, the water level in the suction chamber remains maximum. Accordingly, there is a large difference in the water level between the suction chamber and the interior of the tank body outside the suction chamber when the air inlet is opened. This difference in the water level rapidly drops the water level in the suction chamber. Consequently, the air suction device can vigorously suck air in the toilet drain duct. Consequently, the air suction device can vigorously such air in the toilet drain duct without increase in the size thereof in this flush tank device.

Furthermore, the difference in the water level between the suction chamber and the interior of the tank body outside the suction chamber is reduced with lapse of time after the air inlet has been opened. Accordingly, a suction flow rate of the air suction device is also reduced gradually. This can prevent termination of siphon action in the toilet drain duct due to an excessively large suction flow rate of the suction device in the second half of toilet flushing, with the result that the siphon action can be continued.

Furthermore, in this air suction device, air in the toilet drain duct is continuously sucked until the on-off valve of the outlet is closed after a predetermined amount of flush water is caused to flow from the outlet of the tank body into the toilet body. Thus, the air suction device continues to suck air in the toilet drain duct during occurrence of siphon action, thereby reducing air in the toilet drain duct. Consequently, a flow of flush water is not easily blocked by remaining air, with the result that sewage or the like in toilet drain duct can be conveyed successfully.

One of the valve element and the attracting member may be made of a material having magnetic force, such as permanent magnet, while the other may be made of a ferromagnetic material such as iron. In this case, an opening and closing mechanism for the air inlet of the air suction device is configured to be non-contact with the valve element. This can prevent air leakage from the air suction device.

The float member may be guided by an outer surface of a side defining the suction chamber thereby to ascend and descend. In this case, no independent guide need not be provided to cause the float member to ascend and descend. This can prevent the tank body from being increased in size and render the manufacture of the flush tank device easier.

The float member and the holding portion may be operable in conjunction with each other via a support member with an adjustable length. In this case, the water level at which the float member descends can be changed by changing the length of the support member. More specifically, the timing of start of air suction from toilet drain duct by the air suction device can be changed. Consequently, a suitable timing for start of the air suction by the air suction device can be obtained according to a type of the flushing toilet basin, with the result that the siphon action can reliably be caused in the toilet drain duct.

When descending to a lowermost position, the holding portion moves the attracting member downward to a position where the valve element and the attracting member cannot attract each other, whereupon the valve element may close the air inlet. In this case, when the tank body is drained in a cold weather region, the air inlet communicating with the toilet drain duct can be closed by the valve element. Consequently, odor can be prevented from reverse flowing from the toilet drain duct side.

A return portion may be provided in the valve chest to prevent the valve element from rising above a set height, so that the valve element closes the air inlet without attracting the attracting member when the holding portion rises uppermost. In this case, the air suction device can be on standby in the state before start of toilet flushing with the air inlet being closed by the valve element.

The valve element may be spherical in shape and an upper peripheral edge of the air inlet is formed with an inwardly inclined surface. In this case, the air inlet can smoothly be opened and closed by the valve element.

The air suction device may include the suction chamber defined by a first side surface dividing the interior of the tank body and a first upper surface connected to an upper end of the first side surface and having a through opening, the suction chamber being provided with a communicating hole; a cylindrical guide located below the opening of the first upper surface in the suction chamber and having a first small hole formed through a lower side or a bottom thereof, the guide having an open upper end; a float member inserted through the opening of the suction chamber inserted through the upper end opening of the guide into the guide, the float member descending when the flush water is at or below a set water level lower than a maximum water level of the flush water in the suction chamber; and a valve chest defined by a second side surface rising along a peripheral edge of the opening of the first upper surface of the suction chamber and a second upper surface connected to the second side surface and having the air inlet and a second small hole both formed therethrough, wherein the air inlet and the second small hole communicate via an air suction path with the toilet drain duct, and the air inlet is closed by the float member acting as the on-off valve when the float member ascends.

In this case, the air inlet is closed by the float member at the time of start of toilet flushing. When the outlet of the tank body is opened by the on-off valve so that the toilet flushing starts, the flush water stored in the tank body flows through the outlet into the toilet body, whereby the water level in the interior of the tank body outside the suction chamber starts to drop. On the other hand, since the air inlet is closed by the float member, the water level in the suction chamber gradually drops slowly according to an amount of air flowing only through the second small hole. Subsequently, the float member starts to descend when the water level in the suction chamber drops to or below the set water level. The air inlet is opened with descent of the float member. There is a large difference in the water level between the suction chamber and the interior of the tank body outside the suction chamber at the time the air inlet is opened. This difference in the water level results in sudden drop of the water level in the suction chamber. As a result, the air suction device can vigorously suck air in the toilet drain duct. Thus, the flush tank device can vigorously suck air in the toilet drain duct without increase in size of the air suction device.

Furthermore, the difference in the water level between the suction chamber and the interior of the tank body outside the suction chamber is reduced with lapse of time after the air inlet has been opened. Accordingly, a suction flow rate of the air suction device is also reduced gradually. This can prevent termination of siphon action in the toilet drain duct due to an excessively large suction flow rate of the suction device in the second half of toilet flushing, with the result that the siphon action can be continued.

Furthermore, in this air suction device, air in the toilet drain duct is continuously sucked until the on-off valve of the outlet is closed after a predetermined amount of flush water is caused to flow from the outlet of the tank body into the toilet body. Thus, the air suction device continues to suck air in the toilet drain duct during occurrence of siphon action, thereby reducing air in the toilet drain duct. Consequently, a flow of flush water is not easily blocked by remaining air, with the result that sewage or the like in toilet drain duct can be conveyed successfully.

The float member may have a vent passageway that is defined in an upper side surface thereof so as to communicate between the valve chest and the suction chamber when the float member ascends. In this case, air having flowed from the air inlet and the second small hole into the valve chest can be caused to flow into the suction chamber successfully. Consequently, the air suction device can suck air in the toilet drain duct successfully, with the result that the siphon action can be caused in the toilet drain duct successfully.

The float member may have a flange which is formed on a peripheral edge of an upper end thereof so as to extend outward. The flange has an underside which abuts on an upper surface of the peripheral edge of the opening during descent. In this case, when the tank body is drained in a cold weather region, the opening communicating with the toilet drain duct can be closed by the float member. Consequently, odor can be prevented from reverse flowing from the toilet drain duct side.

The guide may have an upper end located lower than a maximum water level of the flush water in the suction chamber.

In this case, the water level above the upper end of the guide in the suction chamber uniformly drops according to a flow rate of the flush water flowing from a communication hole into a water storage chamber. Furthermore, the water level in the suction chamber vigorously drops after the opening of the air inlet.

When the water level in the suction chamber drops below the upper end of the guide, the flush water in the guide is discharged only through the first small hole, whereupon the water level in the guide drops more slowly than the water level in the interior of the suction chamber outside the guide. This can increase a time period between the opening of the air inlet by the float member and the closure of the opening. Consequently, the air suction device can continuously suck air without closure of the opening by the float member until the on-off valve of the outlet is closed after a predetermined amount of flush water flows through the outlet into the toilet body. Thus, the air suction device continues to suck air in the toilet drain duct during the siphon action, whereby air in the toilet drain duct is reduced.

Consequently, a flow of flush water is not easily blocked by remaining air, with the result that sewage or the like in toilet drain duct can be conveyed successfully.

The air suction device can further have its suction chamber communicating via an air suction path with the toilet drain duct and can be configured such that flush water stored in the suction chamber is released at a lower end of the suction chamber for supply to an outlet of the tank body that communicates with a rim water path provided along an inner peripheral edge of an upper end opening of the toilet bowl.

The air suction device can provide for toilet flushing successfully as described above.

MODE FOR CARRYING OUT THE INVENTION

Embodiments 1 to 5 embodying the air suction device for use with the flush tank device and flush toilet will be described with reference to the accompanying drawings.

<Embodiment 1>

Figure 1:
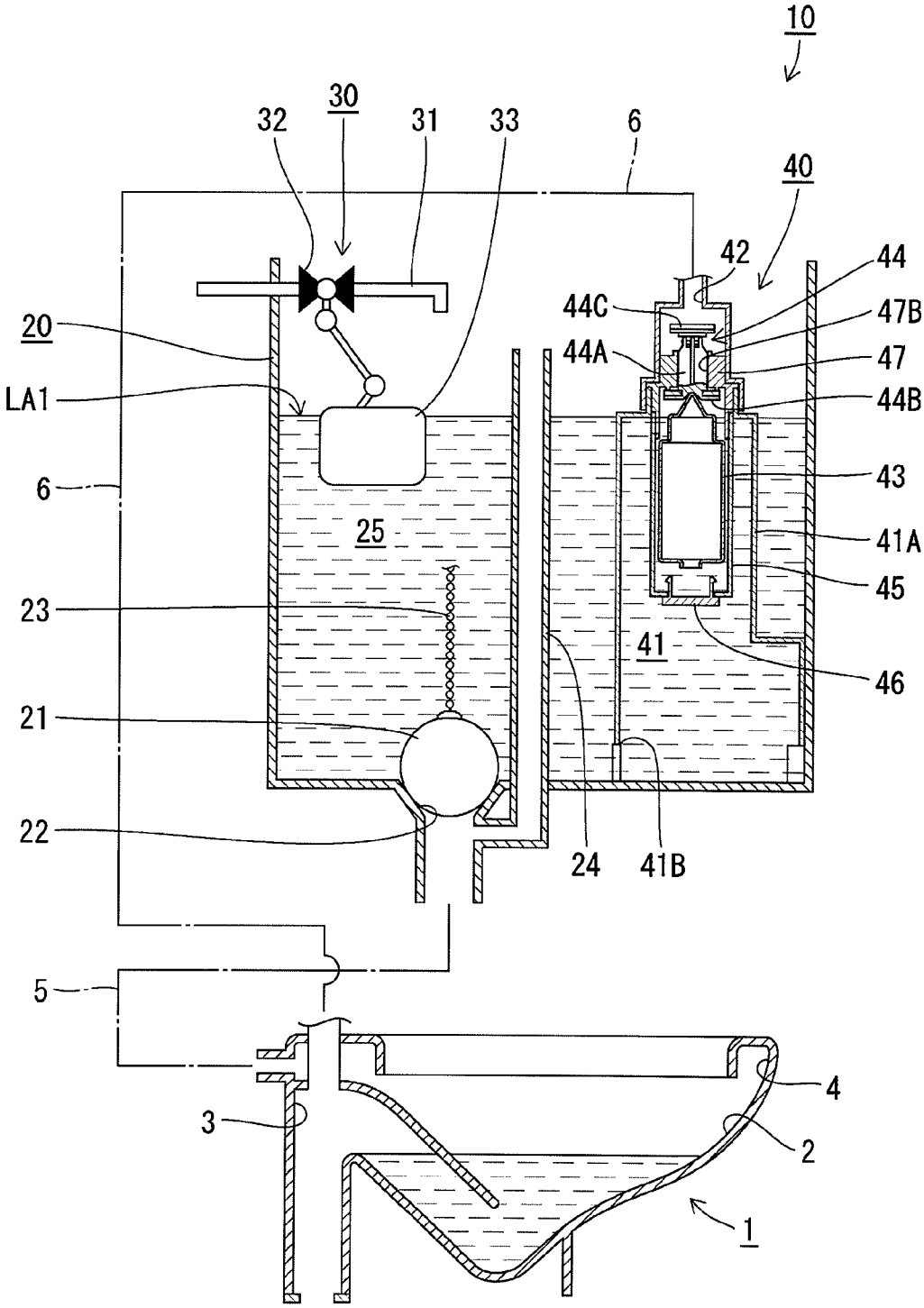
FIG. 1 is a schematic view of a flush toilet according to embodiment 1.

The air suction device according to embodiment 1 operates with a flush toilet that includes a toilet body 1 and a flush tank device 10 mounted on a rear upper surface of the toilet body 1 as shown in FIG. 1. The toilet body 1 includes a toilet bowl 2 and a toilet drain duct 3 communicating with the downstream side of the toilet bowl 2. Furthermore, the toilet bowl 2 has an upper opening with an inner peripheral edge along which a rim water path 4 is provided.

The flush tank device 10 includes a tank body 20, a ball tap 30 serving as a water supply device and an air suction device 40. The tank body 20 has an outlet 22 which is opened and closed by a float valve 21 serving as an on-off valve. The tank body 20 is capable of storing flush water used to flush the toilet body 1. The float valve 21 is connected via a ball chain 23 to a flush handle (not shown). The outlet 22 communicates via a flush water path 5 with the rim water path 4. In toilet flushing, when the user operates the flush handle, the float valve 21 is pulled upward via the ball chain 23, so that flush water stored in the tank body 20 flows through the outlet 22 into the rim water path 4. The tank body 20 has an overflow conduit 24 which has a lower end communicating with the flush water path 5 below the outlet 22 and an upper end which rises upward so as to be located higher than a maximum water level LA1 of the flush water in the tank body 20.

The ball tap 30 includes a water discharge pipe 31 and an on-off valve 32 provided on the water discharge pipe 31. The water discharge pipe 31 is connected to a water supply pipe drawn into a toilet or lavatory where the flush toilet is installed, so as to be capable of directly supplying flush water into the tank body 20. The on-off valve 32 is opened and closed by ascent and descent of a float ball 33. The float ball 33 ascends and descends according to a change in the water level in the tank body 20. More specifically, when the float ball 33 descends, the on-off valve 32 is opened so that the flush water is directly supplied from the water discharge pipe 31 into the tank body 20.

Furthermore, when the water level in the tank body 20 rises to the maximum water level LA1, the on-off valve 32 is closed by the rise of the float ball 33. Thus, the maximum water level LA1 is a water level at which the flush toilet is on standby for toilet flushing.

Figure 2:
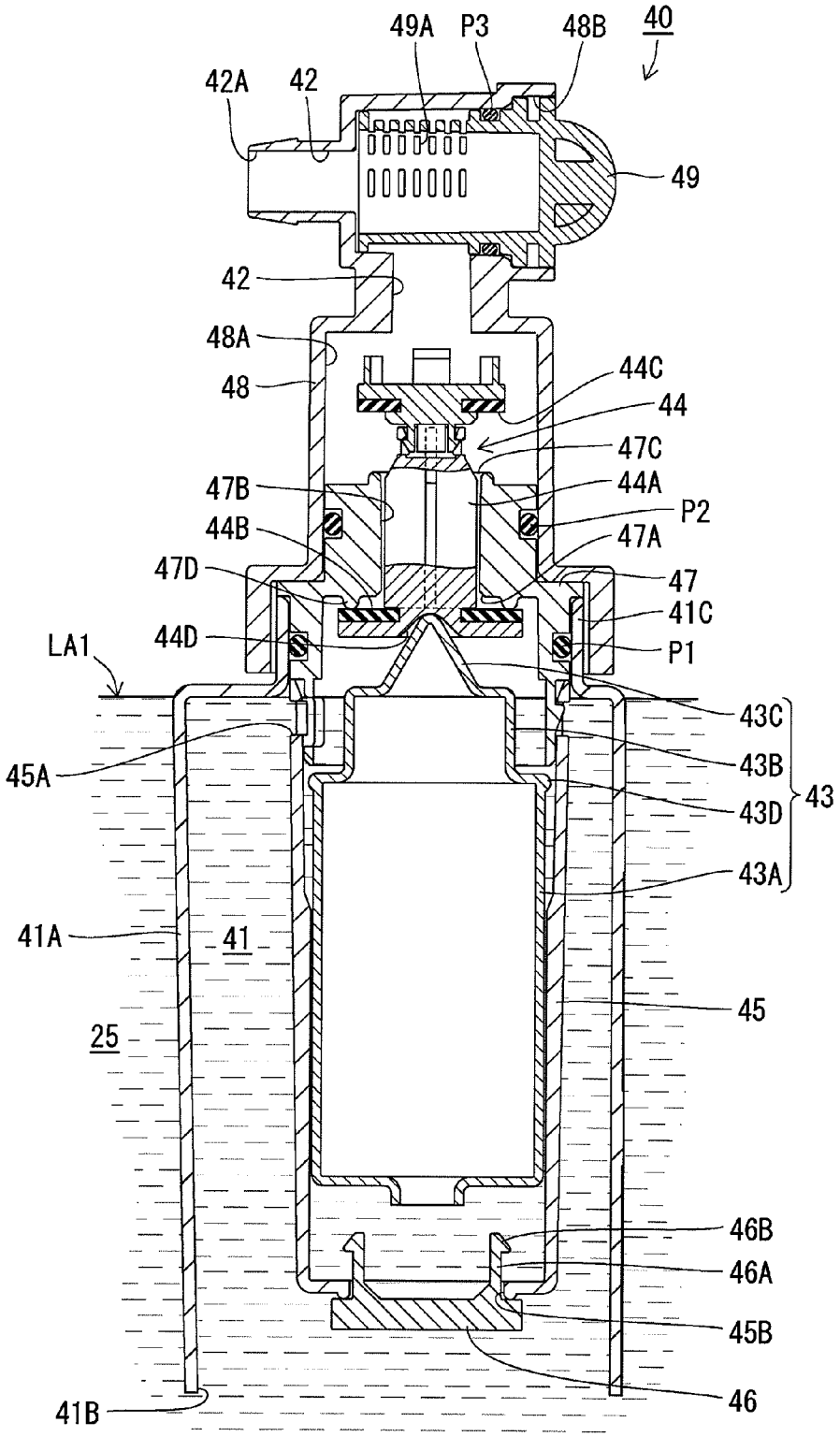
FIG. 2 is a sectional view of an air suction device.
Figure 3:
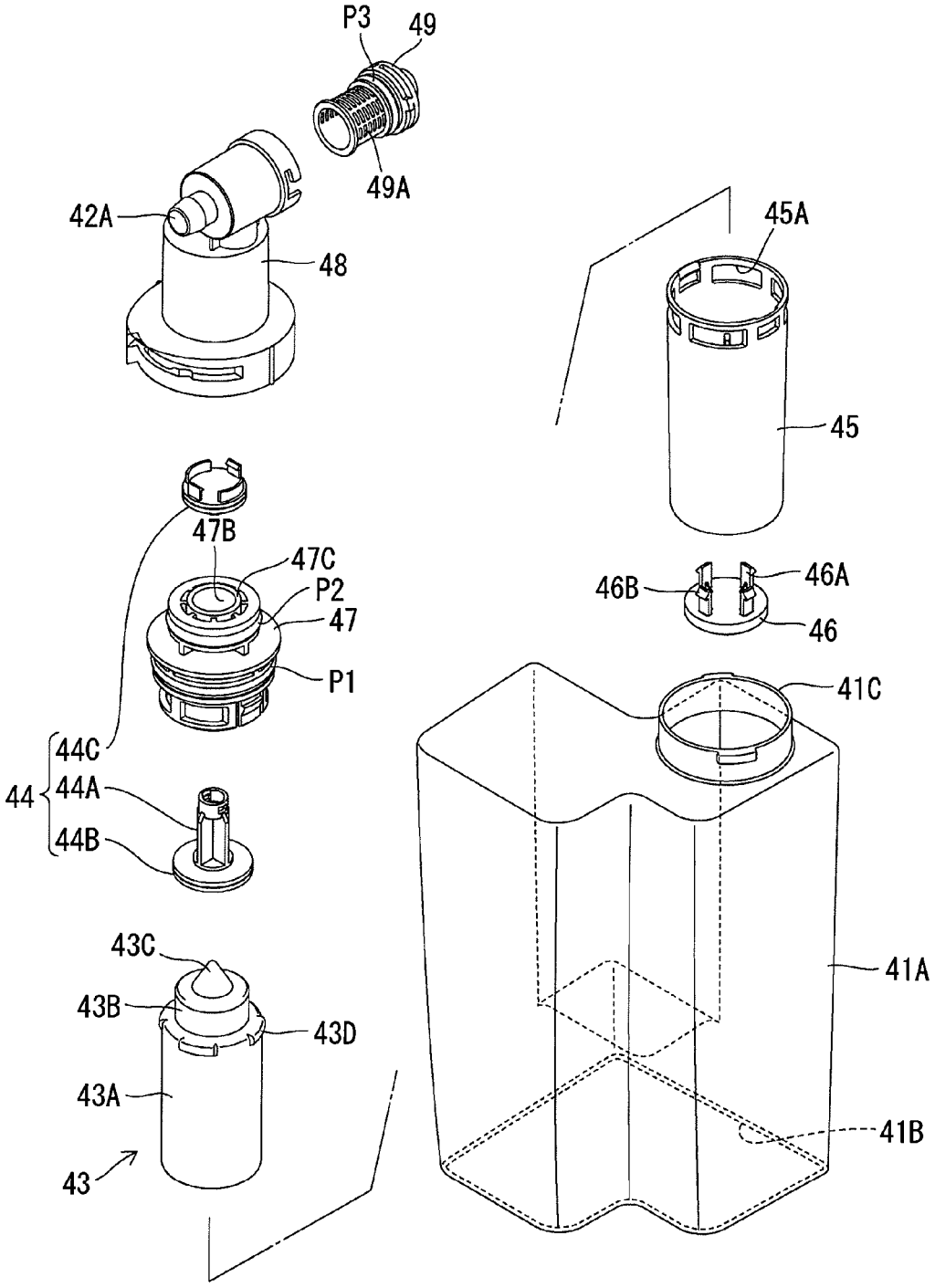
FIG. 3 is an exploded perspective view of the air suction device.

A suction device 40 includes a suction chamber 41, a communication path 42, a float member 43, an on-off valve 44, a guide member 45 and a float valve element 46, as shown in FIGS. 1 to 3.

The suction chamber 41 is defined by a case 41A which is housed in the tank body 20 to divide the interior of the tank body 20. The case 41A has a lower end having a lower end opening 41B open in the tank body 20. The case 41A is disposed with a space between a bottom of the tank body 20 and the lower end opening 41B. More specifically, the suction chamber 41 communicates via the lower end opening 41B with the interior (hereinafter, "storage chamber 25") of the tank body 20 outside the suction chamber 41. Accordingly, flush water is allowed to flow through the lower end opening 41B into and out of the suction chamber 41. The case 41A has an upper surface formed with a cylindrical portion 41C which rises upward so as to be located higher than the maximum water level LA1 in the tank body 20 and which is open in the vertical direction.

A fitting member 47 has a lower part inserted into the cylindrical portion 41C from above. The lower part of the fitting member 47 has a groove which is formed in an outer periphery thereof and in which a packing P1 is fitted. Accordingly, when the lower end of the fitting member 47 is inserted into the cylindrical portion 41C, the packing P1 abuts on an inner periphery of the cylindrical portion 41C, whereby the outer periphery of the lower part of the fitting member 47 and the inner periphery of the cylindrical portion 41C are hermetically joined with each other.

The fitting member 47 has a guide path 47B which is formed through a central part thereof so as to extend in a vertical direction. The guide path 47B guides a shaft 44A of the on-off valve 44 as will be described later. The guide path 47B has a lower end opening formed into a vertically open air inlet 47A. The suction chamber 41 is thus provided with the air inlet 47A which is located higher than the maximum water level LA1 (the water level in the standby for toilet flushing) and which has the vertically extending guide path 47B. The fitting member 47 has a ring-shaped protrusion 47D which protrudes downward along the peripheral edge of the air inlet 47A. Since an upper surface of a first valve element 44B of the on-off valve 44 abuts on the protrusion 47D, air inlet 47A can reliably be closed by the first valve element 44B as will be described later.

The guide path 47B further has an upper end opening 47C having a peripheral edge protruding upward. Since an underside of a second valve element 44C of the on-off valve 44 abuts on upwardly protruding peripheral edge, the upper end opening 47C can reliably be closed by the second valve element 44C as will be described later.

An upwardly extending connecting member 48 is attached to the case 41A so as to cover the cylindrical portion 41C and the fitting member 47 while the fitting member 47 is inserted in the cylindrical portion 41C. The fitting member 47 has an upper portion with an outer periphery formed with a groove in which a packing P2 is fitted. Accordingly, when the connecting member 48 is attached to the case 41A, the packing P2 abuts on an inner periphery of the connecting member 48, whereby the upper outer periphery of the fitting member 47 is hermetically joined with the inner periphery of the connecting member 48.

The connecting member 48 defines an inner space 48A which is located above the fitting member 47 and in which the second valve element 44C of the on-off valve 44 is vertically moved, as will be described later. The connecting member 48 also defines a communication path 42 extending upward from an upper part of the inner space 48A and horizontally curved. The communication path 42 has a horizontally open communication opening 42A. A suction path 6 communicating with the toilet drain duct 3 is connected to the communication opening 42A. The connecting member 48 has an insertion hole 48B which is formed through a side surface thereof opposed to the communication opening 42A of the communication path 42 extending horizontally. A strainer member 49 is to be inserted into the insertion hole 48B.

The strainer member 49 is cylindrical and is inserted into the communication path 42 thereby to close an end face thereof at the side of the insertion hole 48B. The strainer member 49 has a side which is directed crosswise to upward when inserted into the communication path 42 and which is formed with a plurality of slits 49A. The strainer member 49 also has a side which is directed downward and closed. Consequently, when having invaded the communication path 42 from the side of the suction path 6 communicating with the toilet drain duct 3, insects such as flies are caught by the strainer 49, thereby being prevented from falling downward toward the on-off valve 44. Since the downwardly directed side of the strainer member 49 is closed, even insects which are as small as not more than the width of the slits 49A can also be prevented from falling downward toward the on-off valve 44. Furthermore, a packing P3 is fitted in a groove formed in an outer periphery of the strainer member 49 at the insertion hole 48B side. Accordingly, when the strainer member 49 is inserted into the communication path 42, the packing P3 abuts on an inner periphery of the connecting member 48 inside the insertion hole 48B, the outer periphery of the strainer member 49 and the inner periphery of the connecting member 48 are hermetically joined with each other.

The on-off valve 44 comprises a shaft 44A, the first valve element 44B formed integrally on a lower end of the shaft 44A and the second valve element 44C mounted on an upper end of the shaft 44A inserted through the guide path 47B. The shaft 44A has a horizontal section formed into a cross shape. The first valve element 44B is formed into a disc shape and has an upper surface to which a seal material is applied. The first valve element 44B has an upwardly concave recess 44D formed in a central underside thereof. The recess 44D is formed into an angled shape. The second valve element 44C is formed into a disc shape and has an underside to which a seal material is applied.

The guide member 45 is formed into a cylindrical shape and has an upper opening and a lower end formed with a through circular lower opening 45B. The guide member 45 has an inner diameter that is larger in an upper part than in a lower part thereof, whereby the guide member 45 is stepped. The inner diameter of the lower part of the guide member 45 is set to allow a base 43A which will be described later of the float member 43 to be inserted into the lower part of the guide member 45 but to disallow an upper end peripheral edge of the base 43A to be inserted into the lower part of the guide member 45. The upper end peripheral edge of the base 43A is formed with outwardly projecting portions 43D. The guide member 45 has an upper end connected to the lower end of the fitting member 47 and is suspended in the suction chamber 41 defined in the case 41A. The guide member 45 has a plurality of upper openings 45A formed through an upper periphery thereof.

The float valve element 46 is formed into a disc shape and is buoyant. The float valve element 46 has an upper surface formed with four lock strips 46A which are formed so as to extend upward. The lock strips 46A have upper ends formed with outwardly protruding claws 46B respectively. The lock strips 46A are inserted into the lower opening 45B of the guide member 45, whereupon the claws 46B can be engaged with a peripheral edge of the lower opening 45B of the guide member 45 thereby to be locked. The float member 46 is formed so that an outer diameter thereof is larger than the inner diameter of the lower opening 45B of the guide member 45. The float valve element 46 is vertically reciprocable and closes the lower opening 45B of the guide member 45 when ascending by its buoyancy.

The float member 43 includes the cylindrical base 43A having a lower end formed with an opening, a middle portion 43B which is continuous from an upper part of the base 43A and has a smaller diameter than the base 43A, and an upwardly conical protrusion 43C formed on a central upper surface of the middle potion 43B. The base 43A has the plural laterally projecting potions 43D protruding from the upper end periphery thereof. The float member 43 has an interior filled with air and a set buoyancy. The float member 43 is inserted into the upper opening of the guide member 45 thereby to be disposed. The float member 43 cannot be inserted into the guide member 45 from the conical protrusion 43C side since the projecting potions 43D provided on upper end peripheral edge of the base 43A project over the inner diameter of the lower inner periphery of the guide member 45. The projecting portions 43D are thus formed in order to prevent the float member 43 from being inserted into the guide member upside down.

The float member 43 is disposed so that the distal end of the conical protrusion 43C abuts on the central part of the concaved recess 44D formed in the central underside of the first valve element 44B of the on-off valve 44, when ascending.

The following describes a toilet flushing step executed by the flush toilet constructed as described above.

Standby State

Figure 4:
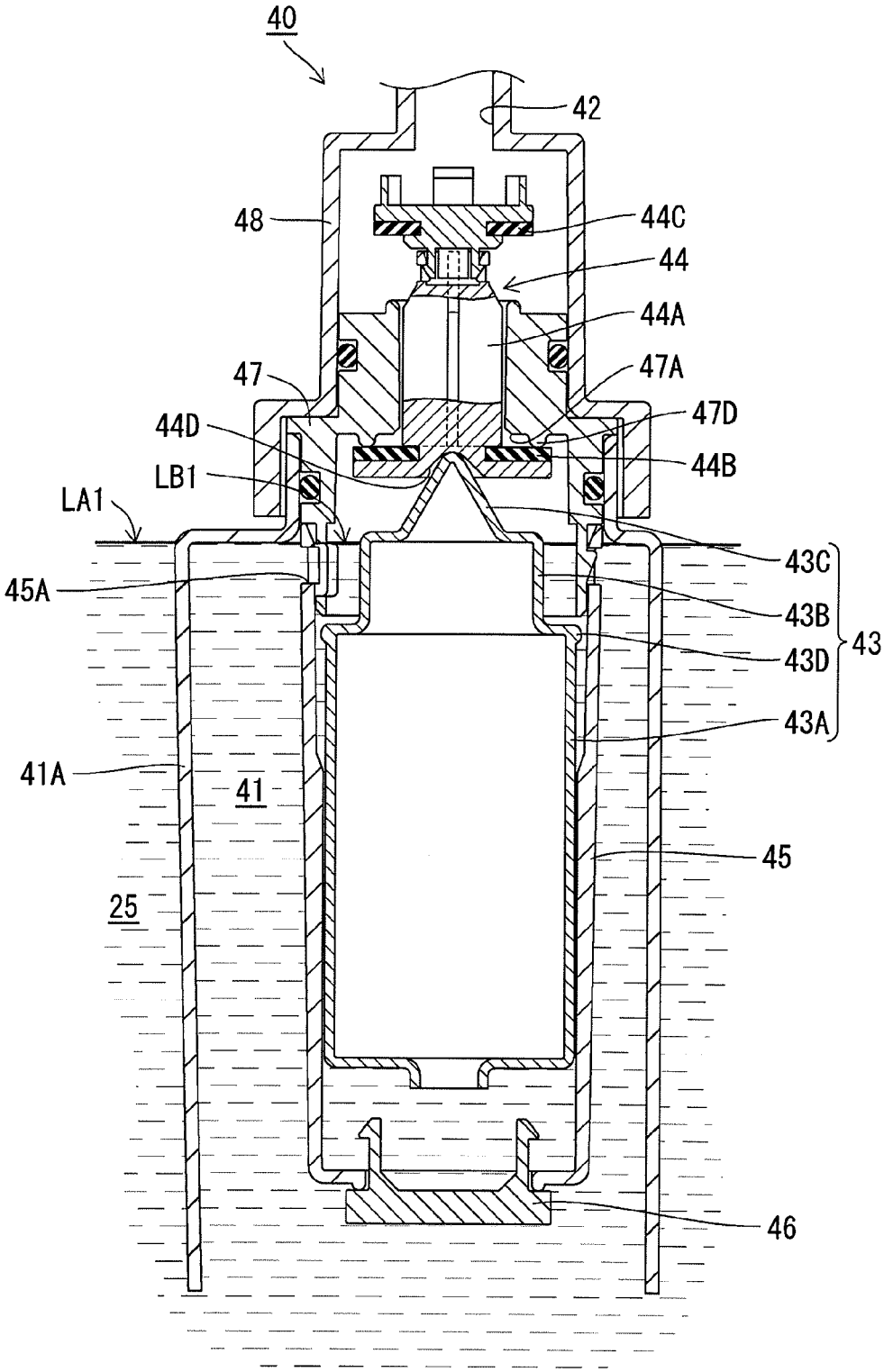
FIG. 4 is a sectional view of the air suction device, showing a standby state for toilet flushing.

In a standby state for toilet flushing, flush water is stored at the maximum water level LA1 in the tank body 20 as shown in FIG. 4. Furthermore, the water level in the suction chamber 41 is at a maximum water level LB1 that is substantially the same as the maximum water level LA1 in the tank body 20. The float member 43 occupies a raised position. Accordingly, the protrusion 43C of the float member 43 abuts on the recess 44D of the on-off valve 44 thereby to push the on-off valve 44 upward.

As a result, the upper surface of the first valve element 44B abuts on the protrusion 47D provided on the peripheral edge of the air inlet 47A, whereby the air inlet 47A is closed by the first valve element 44B.

In this case, since the float member 43 is formed independent of the on-off valve 44, the on-off valve 44 can be raised vertically upward irrespective of an ascending posture of the float member 43, whereupon the air inlet 47A can reliably be closed by the first valve element 44B of the on-off valve 44. Furthermore, the protrusion 43C is provided on the central part of the float member 43, and the recess 44D is provided in the central lower end of the on-off valve 44. Accordingly, the buoyancy of the float member 43 can be transmitted to the central part of the on-off valve 44. Furthermore, since the buoyancy of the float member 43 is concentrated on the distal end of the protrusion 43C, the on-off valve 44 can be raised with a strong force. Consequently, the air inlet 47A can reliably be closed by the first valve element 44B.

Toilet flushing start

Figure 5:
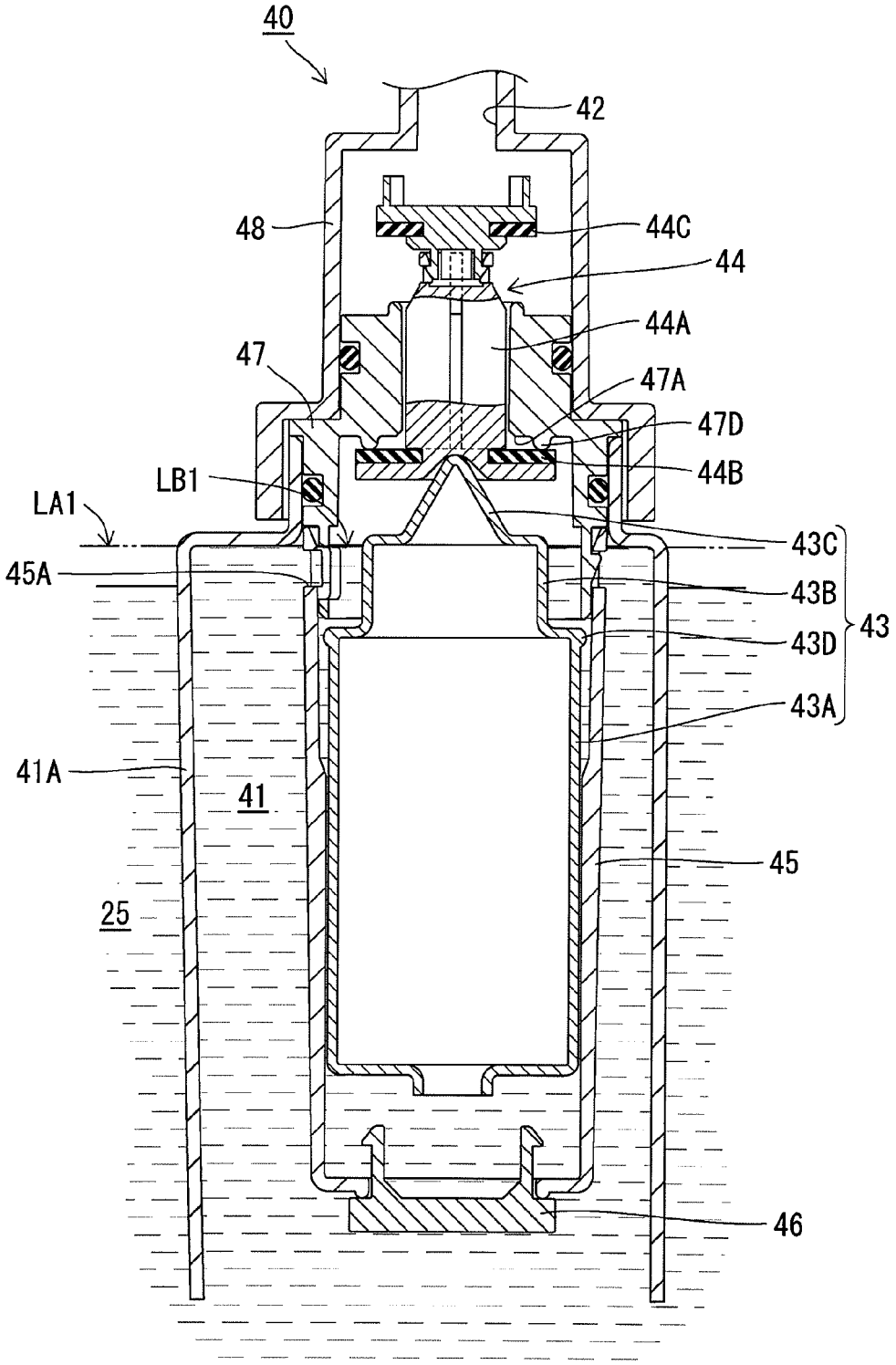
FIG. 5 is a sectional view of the suction device, showing a start state of toilet flushing.

When the user operates the flush handle to raise via the ball chain 23 the float valve 21, the outlet 22 is opened so that flush water stored in the tank body 20 flows through the outlet 22 into the rim water path 4, whereby toilet flushing starts. In this case, the water level in the storage chamber 25 starts to drop as shown in FIG. 5. On the other hand, since the air inlet 47A is closed by the first valve element 44B, outside air is disallowed to flow into the suction chamber 41, whereupon the water level in the suction chamber 41 remains unchanged. More specifically, the suction device 40 does not suck air in the toilet drain duct 3 at this moment.

Suction Start

Figure 6:
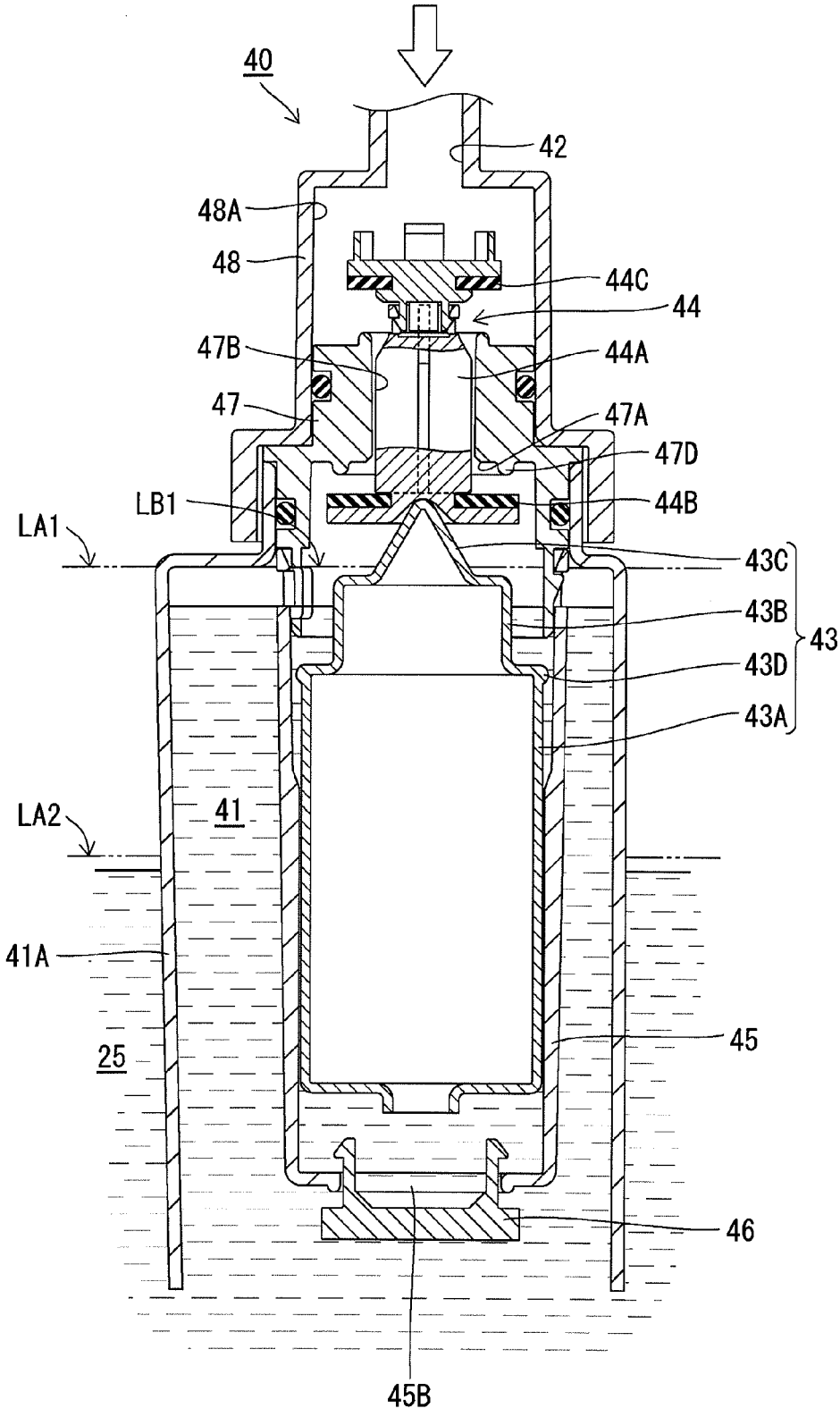
FIG. 6 is a sectional view of the air suction device, showing a suction state.

When the flush water stored in the tank body 20 flows out such that the water level in the storage chamber 25 drops to or below water level LA2, the negative pressure occurring in the suction chamber 41 becomes larger than the buoyancy of the float member 43 and the buoyancy of the float valve element 46 as shown in FIG. 6. As a result, the float member 43 descends from the raised position with the result that the float valve element 46 also descends. Since the on-off valve 44 is moved downward with descent of the float member 43, air inlet 47A is opened.

There is a large difference in the water level between the interior of the suction chamber 41 and the interior of the storage chamber 25. This difference in the water level results in sudden drop of the water level in the suction chamber 41. As a result, air flows from the guide path 47B into the suction chamber 41. More specifically, the suction chamber 41 vigorously sucks air in the toilet drain duct 3 through the inner space 48A communicating with the upstream side of the guide path 47B, the communication path 42 and the suction path 6. Thus, the flush tank device 10 can vigorously suck air in the toilet drain duct 3 without increase in size of the suction device 40.

Furthermore, a time lag can be provided between start of toilet flushing and the opening of the air inlet 47A.

Accordingly, at the time of the opening of the air inlet 47A, a predetermined amount of flush water flows in the toilet drain duct 3 as the result of flow of flush water from the tank body 20 into the toilet body 1, and the flush water flows into the toilet drain duct 3 at a predetermined flow rate. Consequently, when the air suction device 40 vigorously sucks air in the toilet drain duct 3, a siphon action can reliably be caused in the toilet drain duct 3.

Furthermore, since the air inlet 47A is located higher than the maximum water level LA1 (the water level in the toilet flushing standby mode), air in the toilet drain duct 3 can sufficiently be sucked by making the most use of changes in the water level in the suction chamber 41. Consequently, the siphon action can reliably be caused in the toilet drain duct 3.

Accordingly, the flush tank device 10 according to embodiment 1 can perform a desirable toilet flushing.

Figure 7:
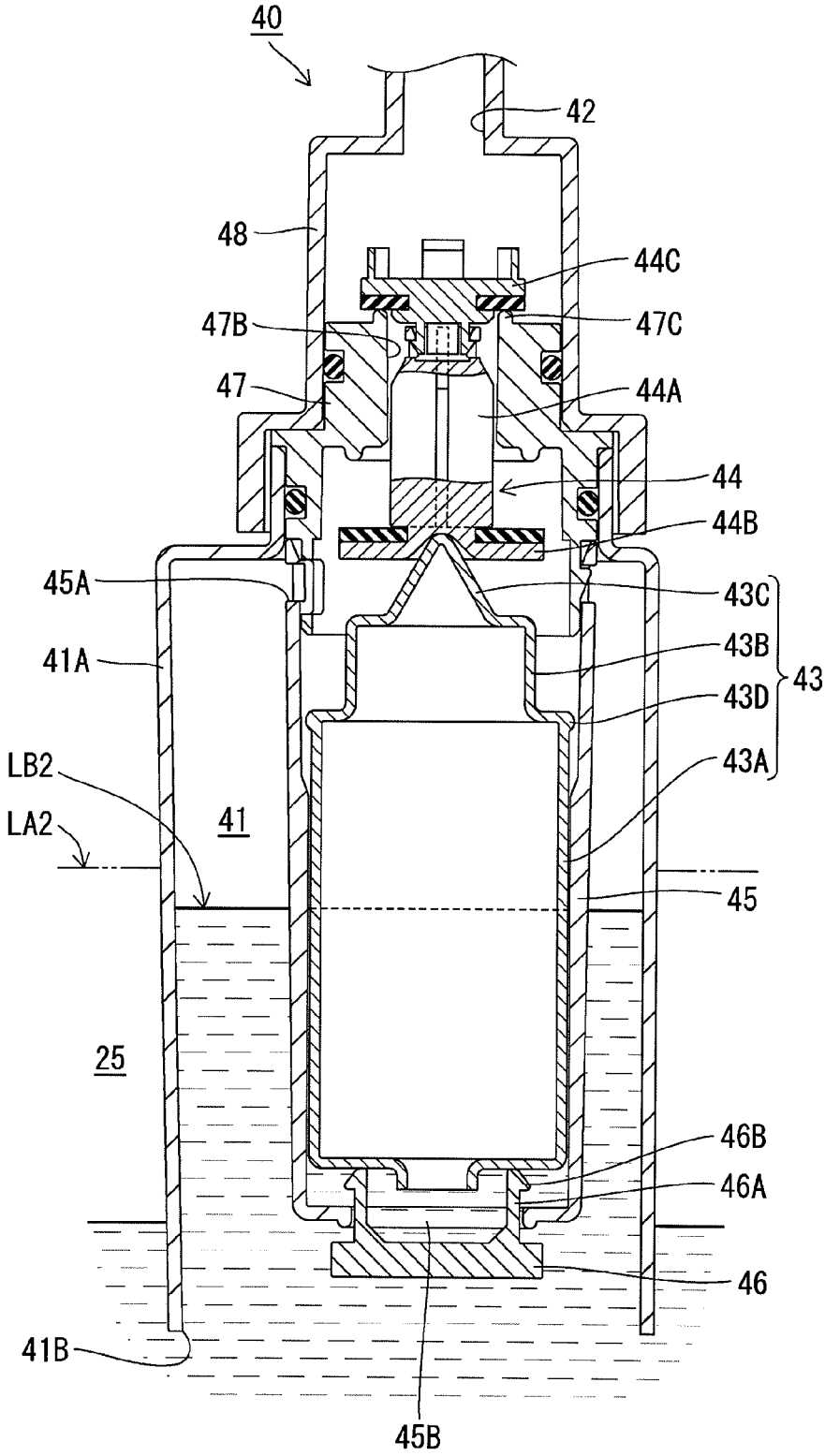
FIG. 7 is a sectional view of the air suction device, showing a suction termination state.

Suction End Furthermore, when flush water stored in the tank body 20 flows though the outlet 22 into the rim water path 4 such that the water level in the suction chamber 41 (including the interior of the guide member 45) drops to or below the set water level LB2, the float member 43 descends to the descent position as shown in FIG. 7. The on-off valve 44 is then moved downward and the underside of the second valve element 44C abuts on the peripheral edge of the upper end opening 47C of the guide path 47B. Accordingly, the upper end opening 47C is closed by the second valve element 44C. This prevents air from flowing from the communication path 42 side into the suction chamber 41. More specifically, air suction from the toilet drain duct 3 by the air suction device 40 is terminated.

Thus, the air suction device 40 terminates air suction from the toilet drain duct 3 during flow of flush water from the tank body 20 into the toilet body 1 in the second half of toilet flushing. Accordingly, the flush water can be prevented from being rendered insufficient in the toilet drain duct 3 due to the air suction device 40 sucking air in the toilet drain duct 3 while the flow rate of flush water flowing from the tank body 20 into the toilet body 1 is reducing, and accordingly, the siphon action can be prevented from being terminated too early. Consequently, the flush toilet can continue the siphon action until near the end of toilet flushing and reliably discharge floating sewage or the like to the downstream of the toilet drain duct 3.

Termination of Toilet Flushing

When flush water stored in the tank body 20 flows through the outlet 22 into the rim water path 4, the flow rate thereof gradually reduces and the siphon action is terminated. Furthermore, when the water level in the storage chamber 25 drops below the lower end opening 41B of the case 41A, the flush water in the suction chamber 41 also flows through the lower end opening 41B and the outlet 22 of the tank body 20 into the rim water path 4. When the water level in the tank body 20 drops to or below the set water level, the outlet 22 is closed by the float valve 21, whereupon the toilet flushing ends.

Storage of Flush Water into Tank Body

Figure 8:
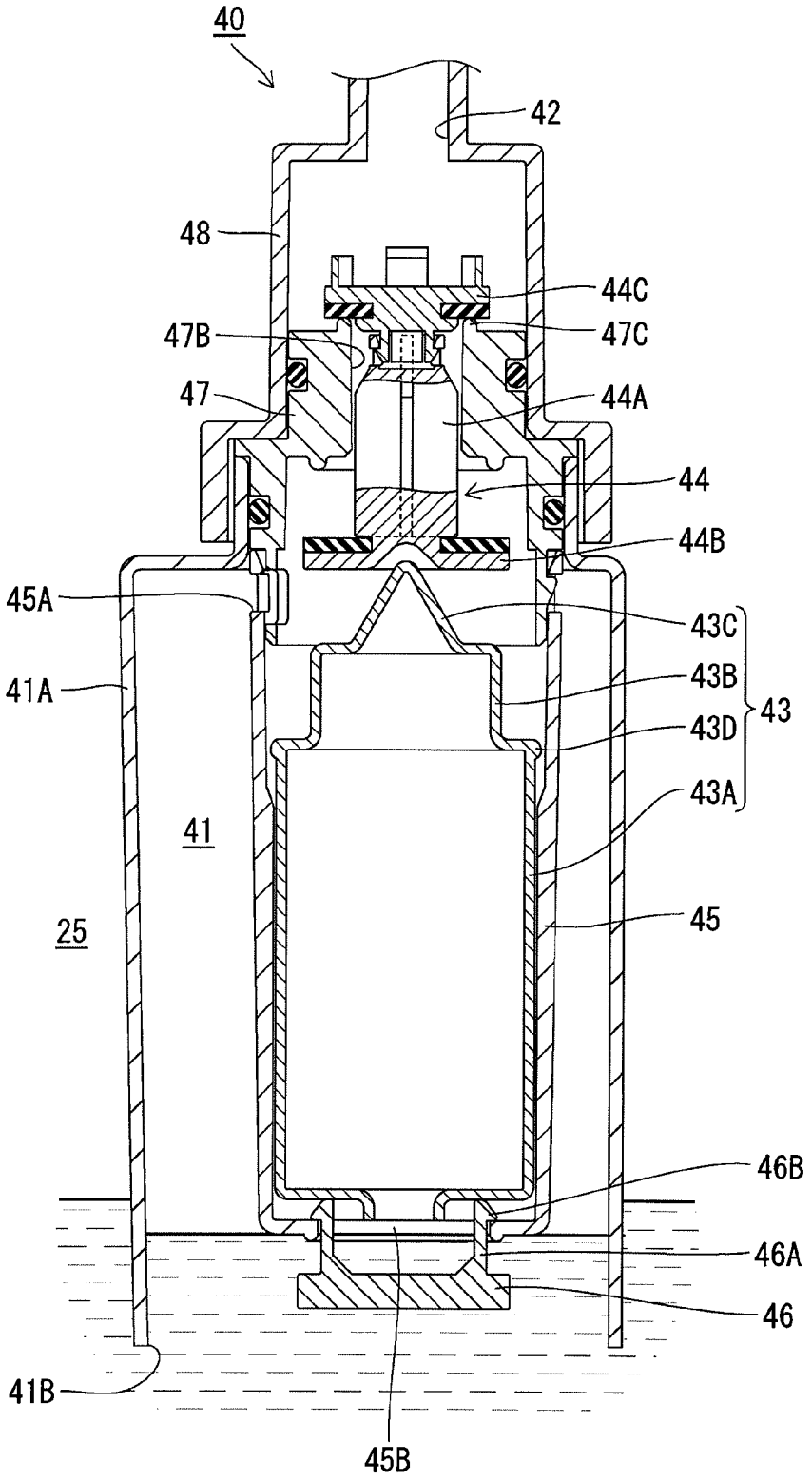
FIG. 8 is a sectional view of the air suction device, showing an initial state of storage of flush water into the tank body.

When the outlet 22 is closed by the float valve 21, flush water starts to be stored in the tank body 20. Flush water then flows through the lower end opening 41B of the case 41A into the suction chamber 41 while air is compressed in the suction chamber 41, and flush water also flows through the lower opening 45B into the guide member 45. Accordingly, the water level in the suction chamber 41 (including the interior of the guide member 45) starts to rise behind the water level rise in the storage chamber 25 as shown in FIG. 8.

When flush water further flows into the guide member 45 with the result that the float member 43 ascends, the on-off valve 44 is pushed upward by the float member 43. Consequently, since the second valve element 44C of the on-off valve 44 also ascends, the upper end opening 47C of the guide path 47B is opened. Then, the compressed air in the suction chamber 41 flows to the communication path 42 side, whereupon the water level in the suction chamber 41 outside the guide member 45 continues to rise with the same water level as in the storage chamber 25.

Figure 9:
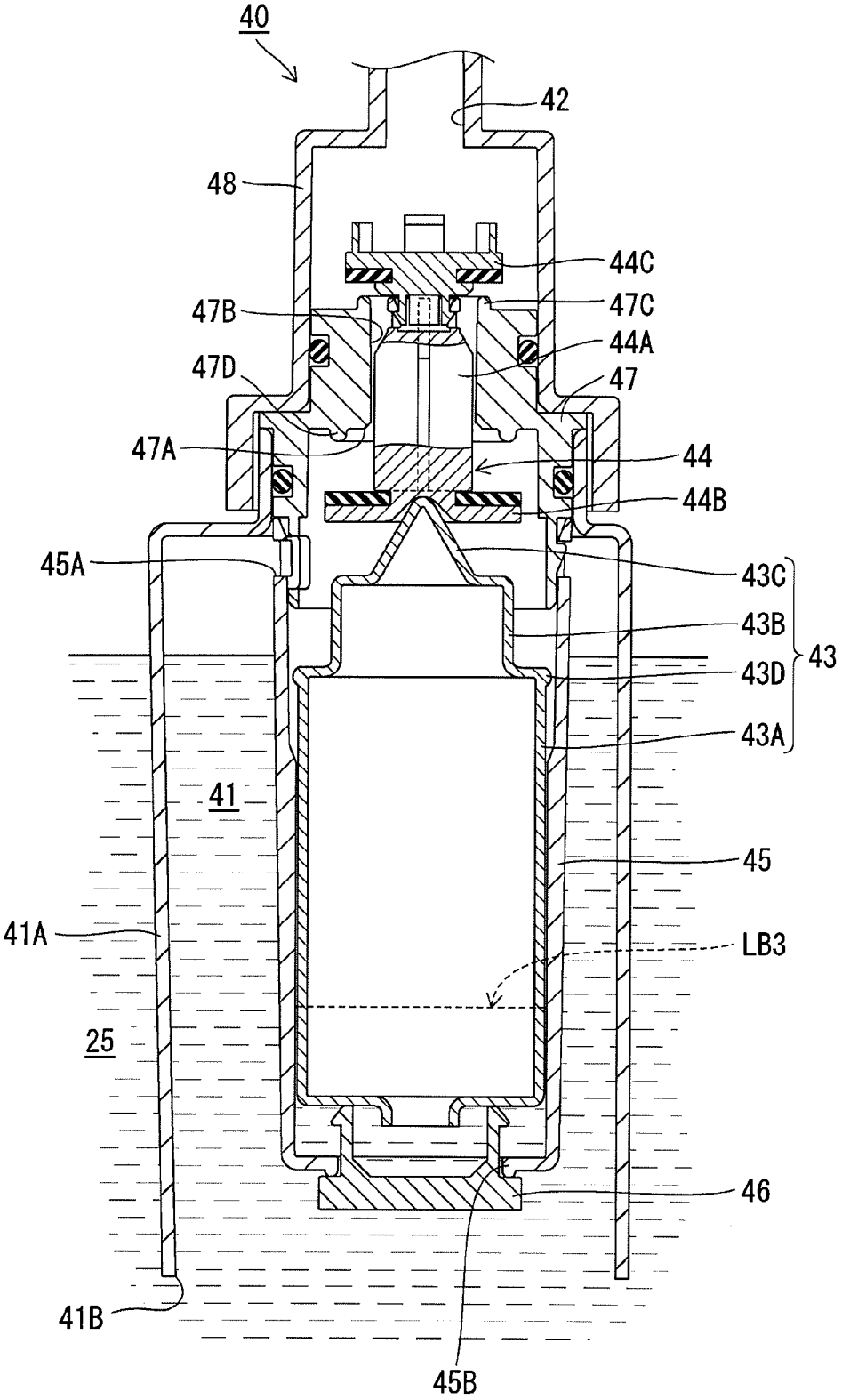
FIG. 9 is a sectional view of the air suction device, showing a state of storage of flush water into the tank body.

The float valve element 46 ascends thereby to close the lower opening 45B when the water level in the suction chamber 41 rises, as shown in FIG. 9. Accordingly, flush water does not flow through the lower opening 45B into the guide member 45, and the water level in the guide member 45 stops rising at the set water level LB3. As a result, the float member 43 stops ascending. In this state, the air inlet 47A is not closed by the first valve element 44B of the on-off valve 44, and the upper end opening 47C of the guide path 47B is not closed by the second valve element 44C, either. Consequently, air is allowed to flow through the guide path 47B to the communication path 42 side, whereupon the water level in the suction chamber 41 outside guide member 45 continues to rise.

The water level in the suction chamber 41 outside guide member 45 continues to rise, so that flush water flows through the upper opening 45A into the guide member 45. The float member 43 then ascends thereby to push the on-off valve 44 upward, whereupon the air inlet 47A is closed by the first valve element 44B of the on-off valve 44.

In this state, since the water level in the storage chamber 25 has risen to the maximum water level LA1, the on-off valve 32 of the ball tap 30 is closed, with the result of stop of flush water discharge through the discharge conduit 31 into the tank body 20, as shown in FIG. 4. Furthermore, the water level in the suction chamber 41 has risen to the maximum water level LB1 that is the same as the maximum water level LA1 in the tank body 20. Thus, the flush toilet returns to the standby state for toilet flushing.

In the flush toilet 10, delaying rise of the float member 43 can render the suction chamber 41 substantially full of flush water until the air inlet 47A is closed by the on-off valve 44. Accordingly, the suction device 40 can suck air in the toilet drain duct 3 successfully in the next toilet flushing.

Figure 10:
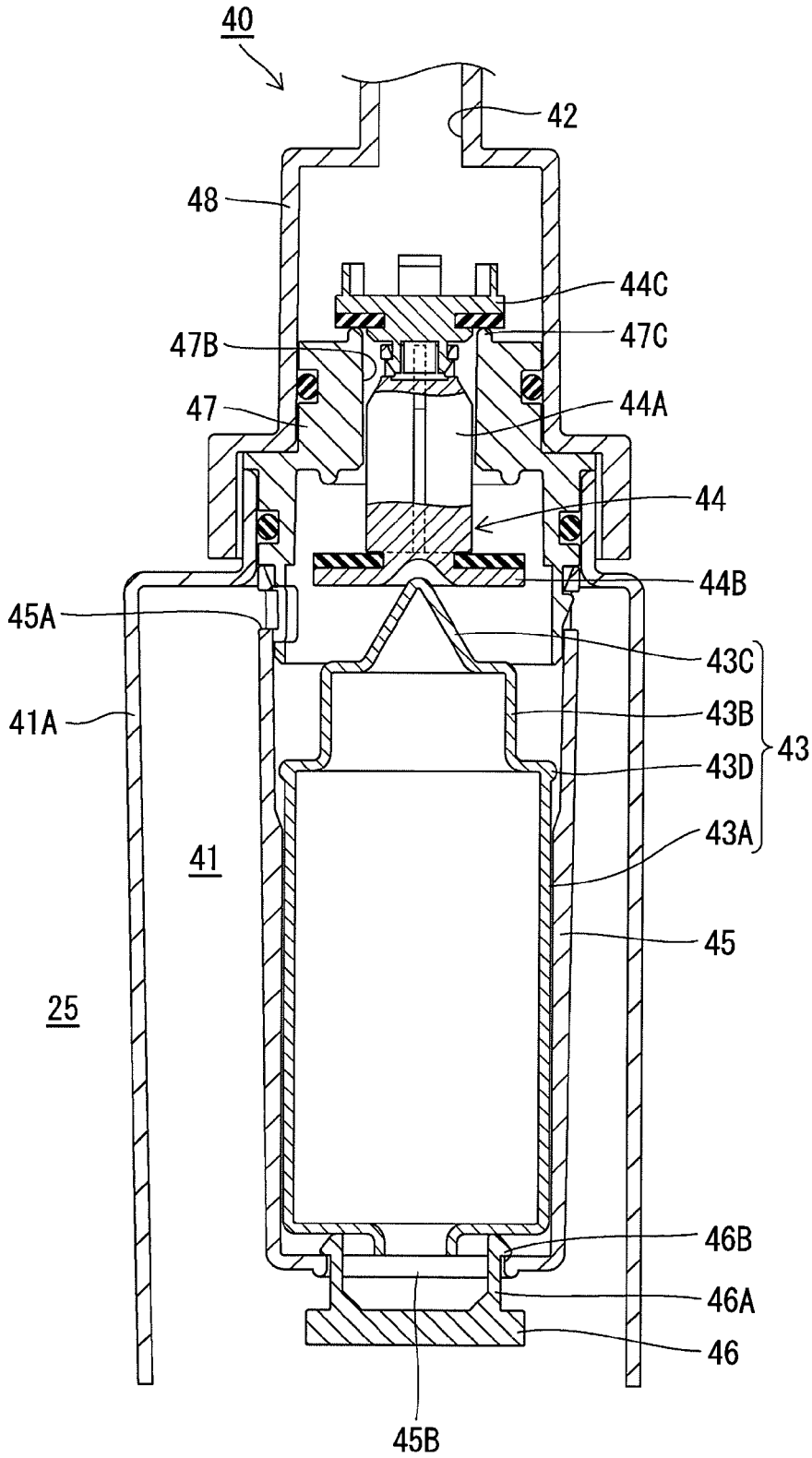
FIG. 10 is a sectional view of the air suction device, showing a drained state of the tank body.

When the tank body 20 of the flush tank device 10 is drained in a cold weather region, the float member 43 descends below the set descent position as shown in FIG. 10. As a result, the on-off valve 44 is moved downward, and the underside of the second valve element 44C abuts on the peripheral edge of the upper end opening 47C of the guide path 47B, with the result that the upper end opening 47C is closed by the second valve element 44C. Consequently, air can be prevented from flowing from the communication path 42 side into the suction chamber 41. More specifically, odor can be prevented from reverse flowing from the toilet drain duct 3 side.

<Embodiment 2>

The air suction device according to embodiment 2 differs in the construction of the suction chamber 140 from embodiment 1, as shown in FIGS. 11 to 17. The other construction of the flush toilet in embodiment 2 is the same as in embodiment 2. Identical parts in embodiment 2 are labeled by the same reference symbols as those in embodiment 1, and detailed description of these parts will be eliminated.

The flush tank device 110 includes the tank body 20, the ball tap 30 serving as the water supply device, and the suction device 140. The suction device 140 includes the suction chamber 141, the air inlet 142, the valve chest 143, the valve element 144 serving as the on-off valve, the float member 145 and a holding portion 146 holding an attracting member 147.

The suction chamber 141 is formed by a vertically extending cylindrical side 141A dividing the interior of the tank body 20 and a top 141B connected to an upper end of the side 141A. The top 141B is located slightly higher than the maximum water level LA1 in the tank body 20 (the water level in the standby for toilet flushing). The side 141A has a lower end formed with a through communication hole 141C directed laterally. The suction chamber 141 and the interior (hereinafter, "storage chamber 25") of the tank body 20 outside the suction chamber 141 communicate via the communication hole 141C with each other.

An upwardly extending cylindrical portion 141D is formed on a central part of the top 141B of the suction chamber 141. An outwardly extending flange 141E is formed on an upper end outer edge of the cylindrical portion 141D. A partition 142A is formed on a middle inner surface of the cylindrical portion 141D. The partition 142A is provided with a vertically opening air inlet 142. The air inlet 142 is located higher than the maximum water level LB1 in the suction chamber 141 that is the maximum water level LA1 in the tank body 20 (the water level in the standby for toilet flushing). As a result, the air inlet 142 and the valve element 144 can be prevented from going under flush water and from being secured together by wash fluid or the like added to flush water. Furthermore, since changes in the water level in the suction chamber 141 can be made the most use of, the suction device 140 can sufficiently suck air in the toilet drain duct 3.

The upper peripheral edge of the air inlet 142 is formed into an inwardly inclined surface, which serves as a valve seat 142B of the valve element 144. Consequently, the valve element 144 can be moved smoothly and accordingly, the air inlet 142 can be opened and closed smoothly.

The valve chest 143 is defined in the cylindrical portion 141D located above the partition 142A. The valve chest 143 has an upper end opening 143A communicating via the suction path 6 with an upper end of the toilet drain duct 3. A ball-like valve element 144 is housed in the valve chest 143 and is capable of opening and closing the air inlet 142. The valve element 144 is made of an iron ball having an outer surface coated with resin. The valve chest 143 has an upper inner surface formed with an inwardly protruding return portion 143B. The return portion 143B prevents the vent element 144 from moving upwardly thereabove.

The float member 145 is formed into a cylindrical shape and has a slightly larger diameter than the side 141A forming the suction chamber 141. The float member 145 is disposed in the storage chamber 25 with the suction chamber 141 being inserted therethrough. Since a space between the inner surface of the float member 145 and an outer surface of the side 141A defining the suction chamber 141 is small, the float member 145 ascends and descends while being guided by the outer surface of the side 141A. Accordingly, since no separate guide is required to cause the float member 145 to ascend and descend smoothly, the tank body 20 can be prevented from being increased in size, and the flush tank device can easily be manufactured.

The holding portion 146 includes a disc-shaped bottom plate 146A having a central opening through which the cylindrical portion 141D is inserted, a cylindrical sidewall 146B rising along the outside of the opening of the bottom plate 146A, and a disc-shaped upper plate 146C which extends inward from an upper end inner edge of the sidewall 146B and has a central opening through which the cylindrical portion 141D is inserted. The bottom plate 146A has bar-like supports 145A extending downward from a plurality of portions of an outer peripheral edge thereof respectively. The supports 145A have respective lower ends to which the float member 145 is connected. The holding portion 146 thus constructed is movable upward and downward along the cylindrical portion 141D with ascent and descent of the float member 145.

The attracting member 147 is made of an annular permanent magnet. The attracting member 147 has an outer diameter that is slightly smaller than a diameter of an inner peripheral surface of the sidewall 146B of the holding portion 146. Furthermore, the attracting member 147 also has an inner diameter that is slightly larger than a diameter of an outer peripheral surface of the cylindrical portion 141D and smaller than an outer diameter of the flange 141E. The attracting member 147 has a central through hole through which the cylindrical portion 141D is inserted. The attracting member 147 is disposed in the holding portion 146. A space is defined between an upper surface of the bottom plate 146A of the holding portion 146 and the underside of the upper plate 146C. The space is set so as to be larger than a thickness of the attracting member 147.

The attracting member 147 formed as described above is movable upward and downward along the cylindrical portion 141D. More specifically, the attracting member 147 is movable upward to a position where the attracting member 147 is locked by the flange 141E (an uppermost position) and movable downward to a position where the attracting member 147 is placed on the bottom plate 146A of the holding portion 146 located on the top 141B (a lowermost position). The attracting member 147 attracts the valve element 144 or vice versa when the attracting member 147 is moved upward or downward along the cylindrical portion 141D and a space between the attracting member 147 and the valve element 144 is within a set range. As a result, the valve element 144 is moved to open the air inlet 142.

Figure 15:
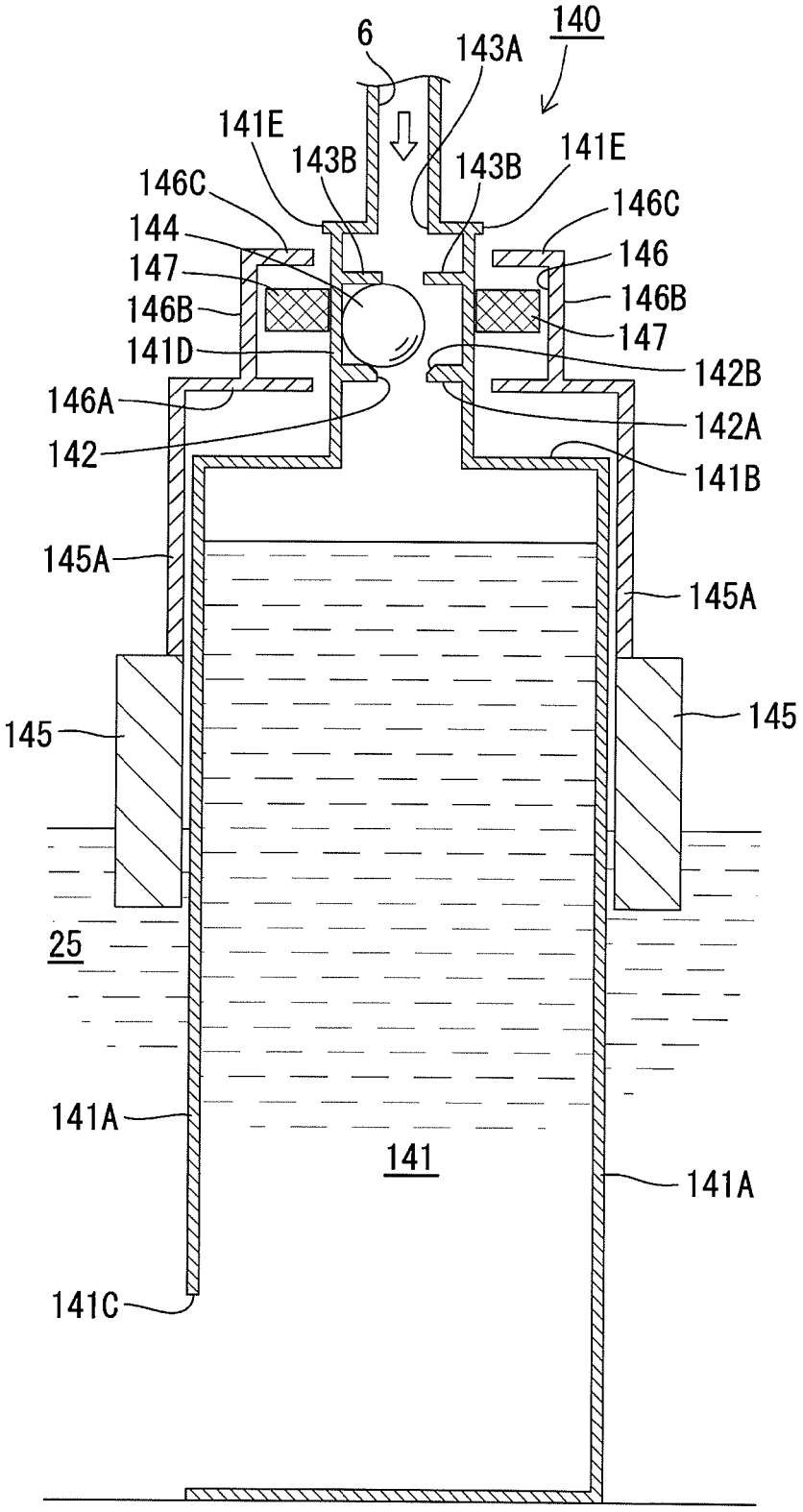
FIG. 15 is a sectional view of the air suction device, showing the air suction state.

The attracting member 147 is moved downward with downward movement of the holding portion 146 further with descent of the float member 145. The attracting member 147 attracts the valve element 144 during the downward movement or vice versa thereby to move the valve element 144, whereby the air inlet 142 is opened. In this case, the attracting member 147 is not moved downward by the self-weight due to an attractive force between the valve element 144 and itself, as shown in FIG. 15. The holding portion 146 is further moved downward, and the attracting member 147 is pushed downward by the upper plate 146C thereby to occupy a position such that the attracting member 147 and the valve element 144 cannot attract each other. Furthermore, since the valve element 144 cannot attract the attracting member 147, the valve element 144 is moved to a position to close the air inlet 142. The float member 145 is capable of descending at or below the set water level LA2 lower than the maximum water level LA1 in the storage chamber 25.

The attracting member 147 occupying the lowermost position is pushed upward by the bottom plate 146A of the holding portion 146 with upward movement of the holding portion 146 further with ascent of the float member 145, whereby the attracting member 147 is moved upward. The attracting member 147 attracts the valve element 144 or vice versa during the ascent thereby to move the valve element 144, whereby the air inlet 142 is opened. Since the valve element 144 is disallowed to move over the return portion 143B, the valve element 144 and the attracting member 147 do not attract each other when the attracting member 147 occupies the uppermost position, whereupon the valve element 144 drops thereby to close the air inlet 142.

The following describes a toilet flushing step executed by the flush toilet constructed as described above.

Standby State

Figure 11:
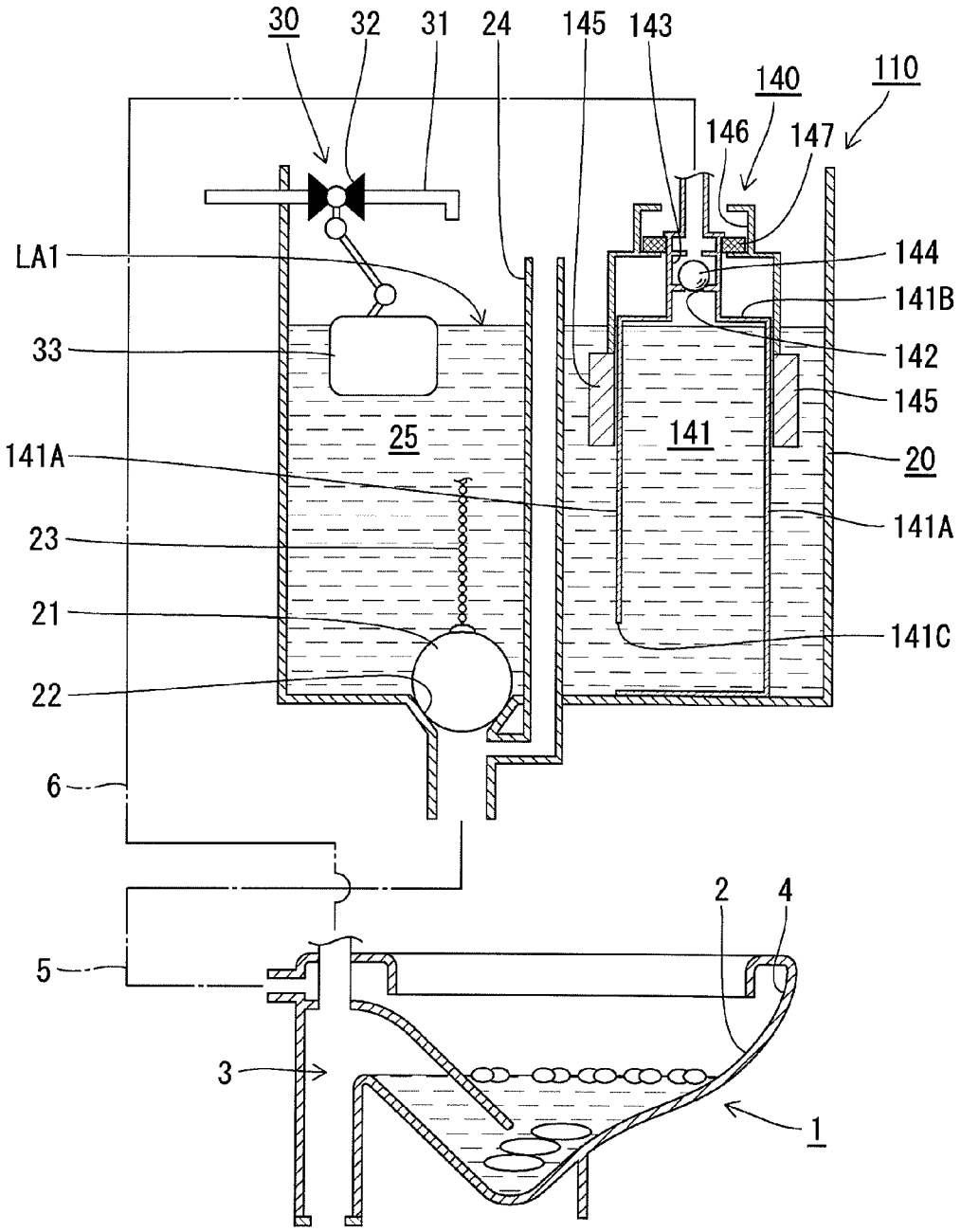
FIG. 11 is a schematic view of the flush toilet according to embodiment 2.
Figure 12:
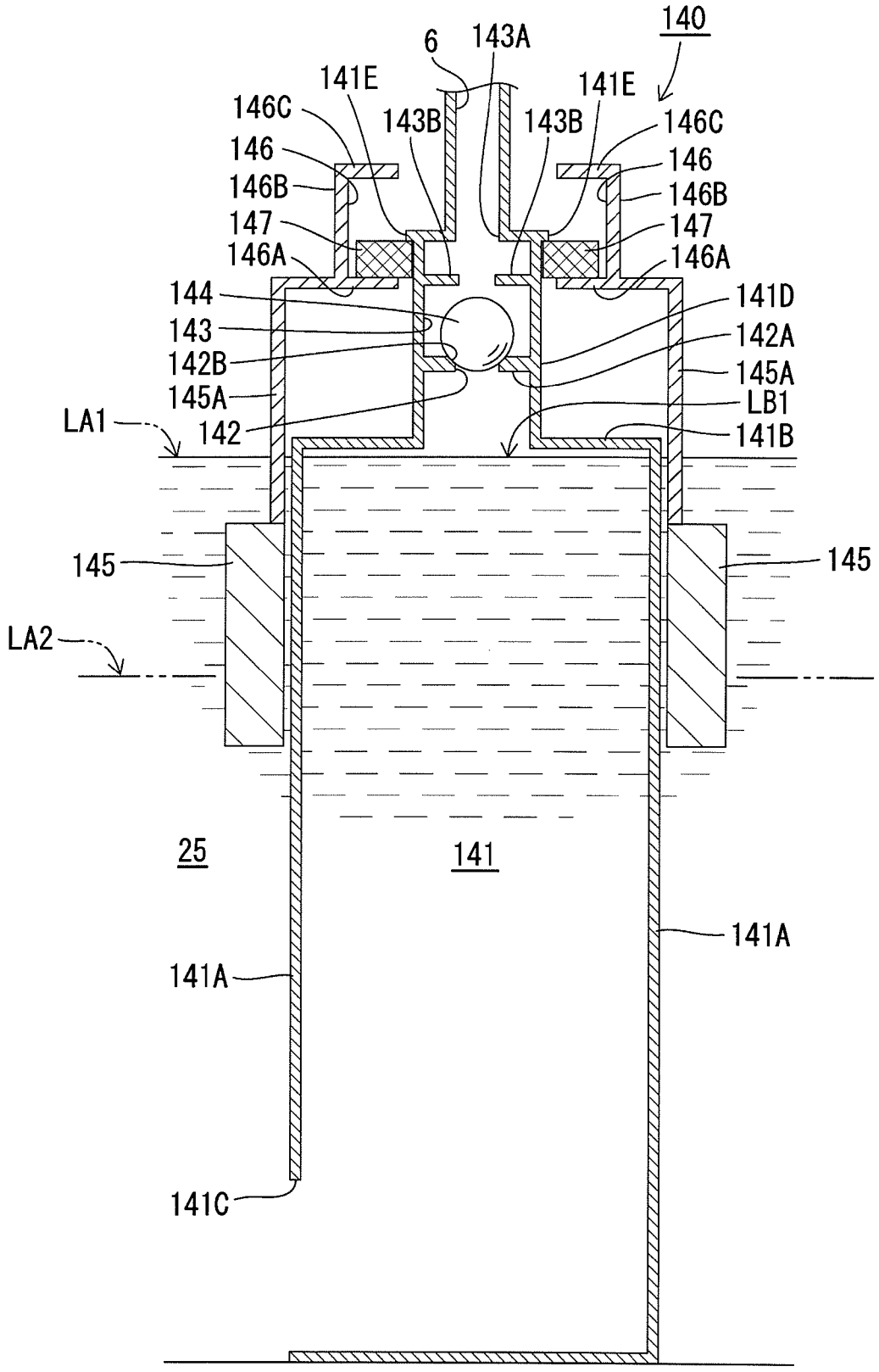
FIG. 12 is a sectional view of the air suction device, showing a standby state for toilet flushing.

In the standby state for toilet flushing, a predetermined amount of flush water is stored in the tank body 20 as shown in FIGS. 11 and 12. More specifically, the storage chamber 25 stores flush water reaching the maximum water level LA1, and the water level in the suction chamber 141 is at a maximum water level LB1. The air inlet 142 of the suction device 140 is closed by the valve element 144. Since the attracting member 147 has been moved upward thereby to be locked by the flange 141E, the float member 145 is not allowed to ascend, sinking in the flush water in the storage chamber 25.

Toilet Flushing Start

When the user operates the flush handle to start toilet flushing, the float valve 21 is raised via the ball chain 23, so that the outlet 22 is opened. Flush water stored in the storage chamber 25 then flows through the outlet 22 into the rim water path 4. In this case, the water level in the storage chamber 25 suddenly drops. On the other hand, since the air inlet 142 is closed by the valve element 144, the water level in the suction chamber 141 remains unchanged at maximum water level LB1.

Figure 13:
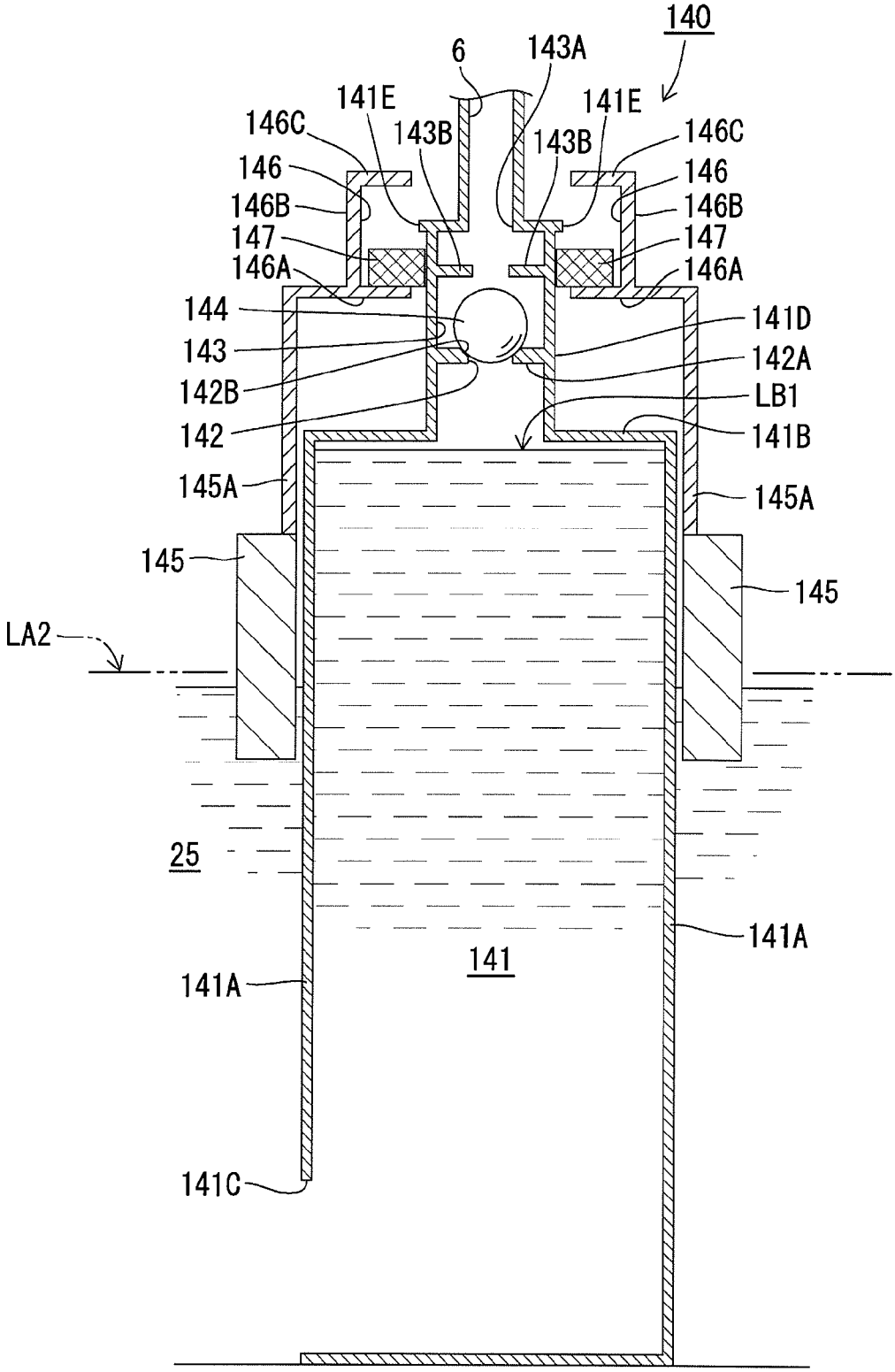
FIG. 13 is a sectional view of the air suction device, showing the state thereof immediately before air suction.

Subsequently, when flush water in the storage chamber 25 continues to flow through the outlet 22 into the rim water path 4 such that the water level in the storage chamber 25 drops to or below the set water level LA2, the float member 145 starts to descend, as shown in FIG. 13. As a result, the holding portion 146 holding the attracting member 147 also starts to move downward. At an initial stage of the downward movement of the float member 145, the holding portion 146 and the attracting member 147, the attracting member 147 and the valve element 144 do not attract each other since the space therebetween is out of the set range. Accordingly, since the air inlet 142 is kept closed by the valve element 144, the water level in the suction chamber 141 remains unchanged at the maximum water level LB1.

Suction Start

Figure 14:
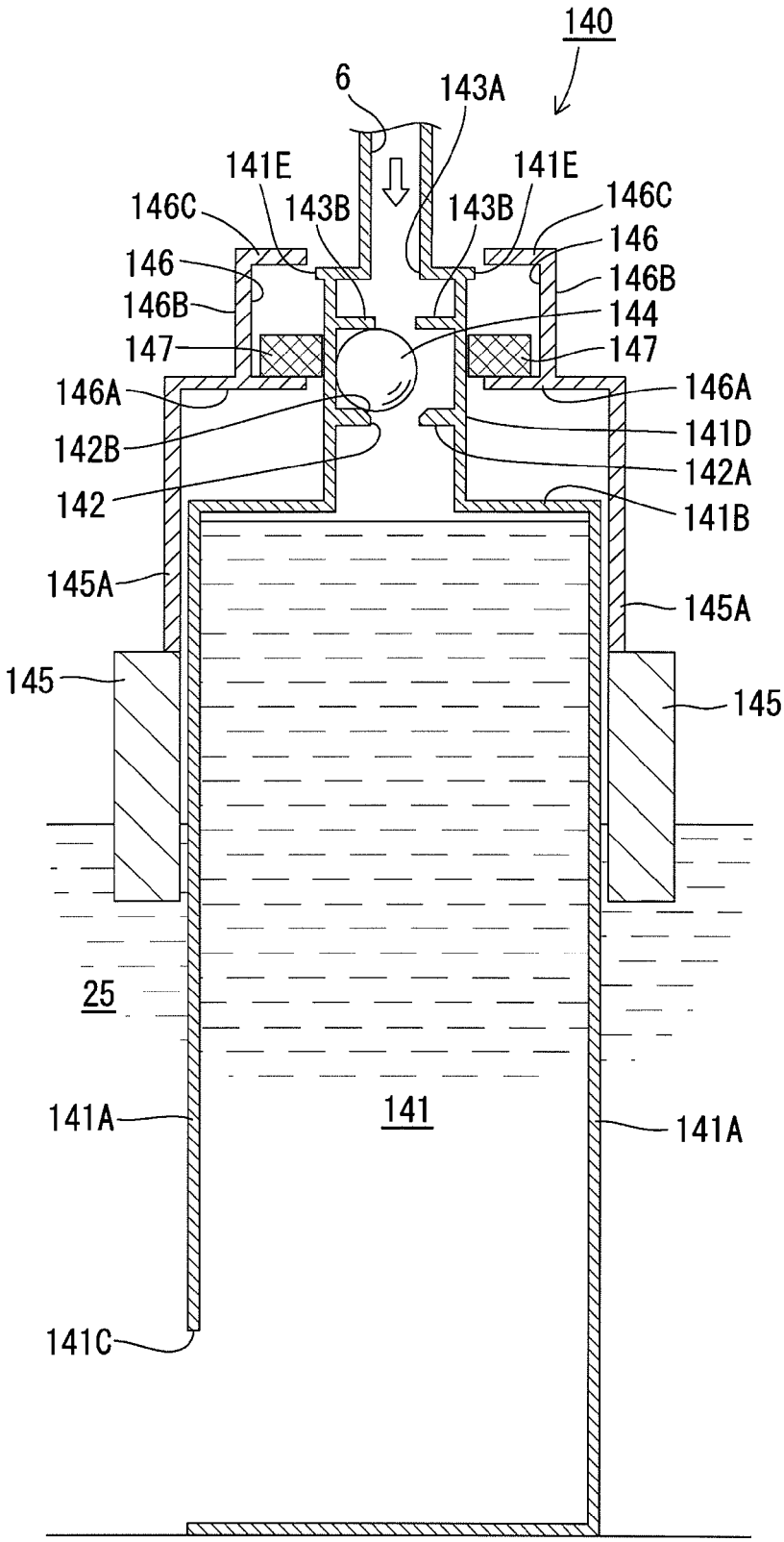
FIG. 14 is a sectional view of the air suction device, showing the state thereof immediately after suction start.
Figure 16:
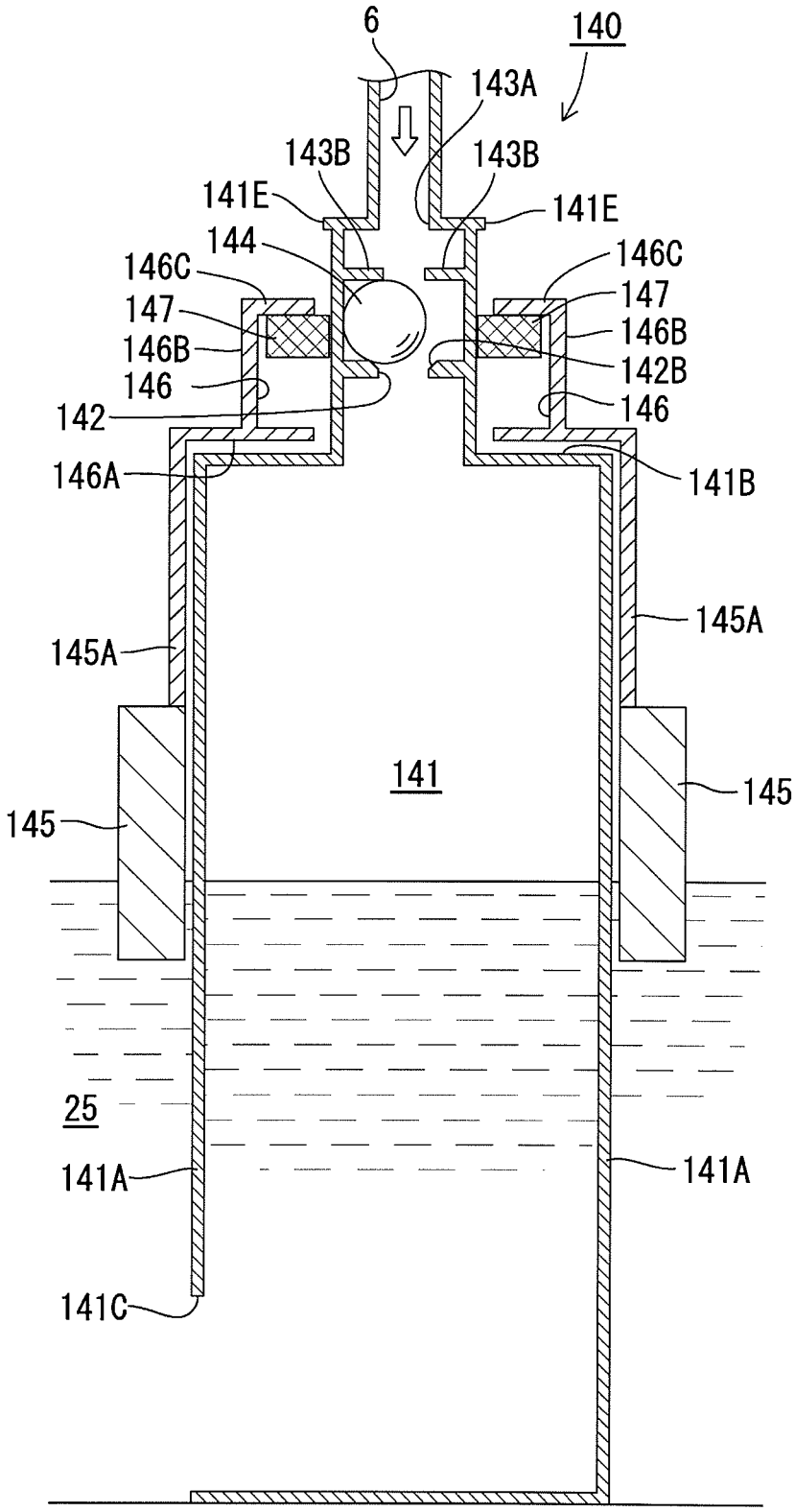
FIG. 16 is a sectional view of the air suction device, showing the air suction state.
Figure 17:
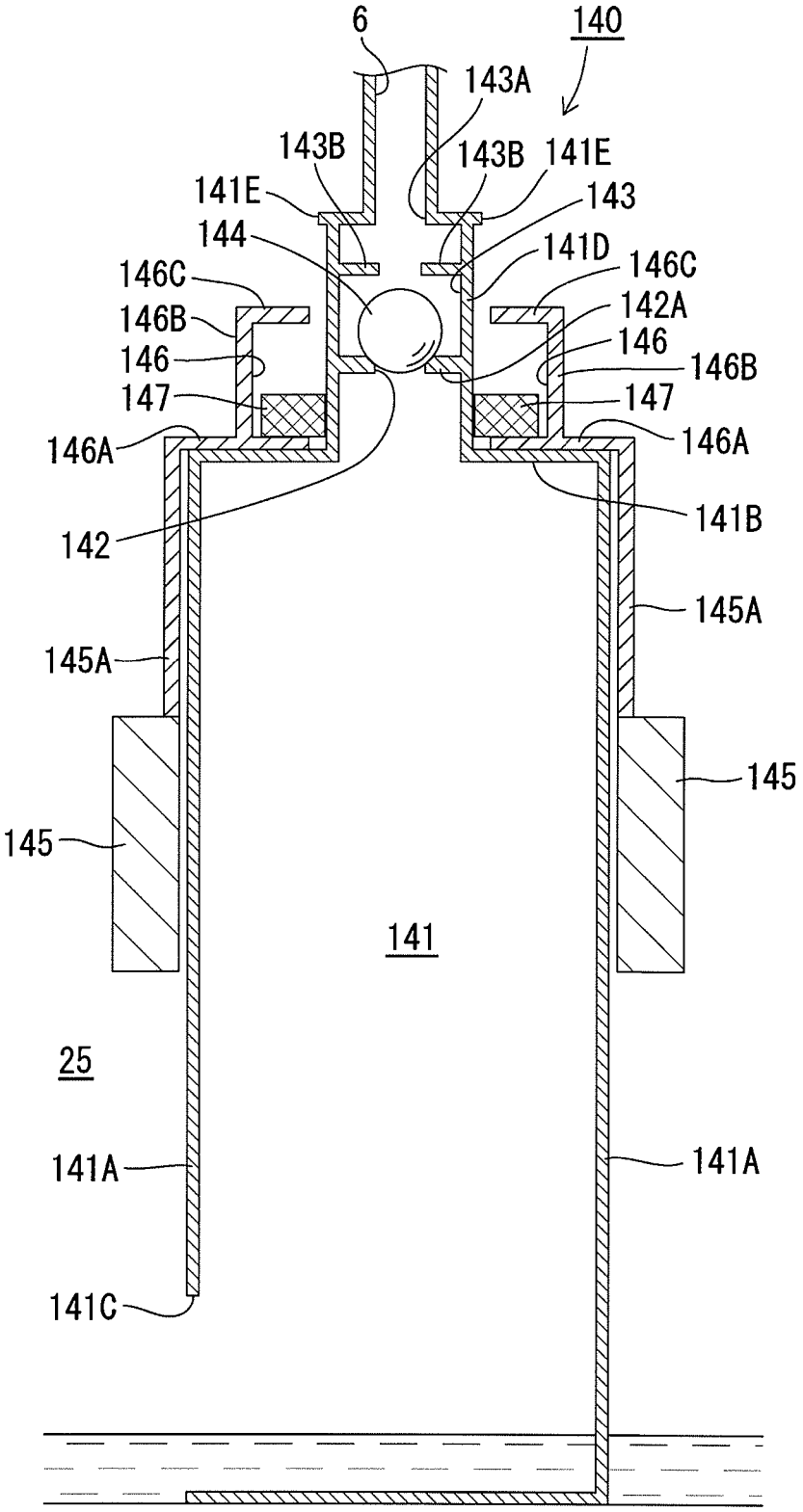
FIG. 17 is a sectional view of the air suction device, showing a drained state of the tank body.

When the flush water stored in the storage chamber 25 continues to flow through the outlet 22 into the rim water path 4 such that the water level in the storage chamber 25 drops, the float member 145, the holding portion 146 and the attracting member 147 further are moved downward as shown in FIG. 14. As a result, the attracting member 147 and the valve element 144 come near the set range. The attracting member 147 and the valve element 144 then attract each other, so that the valve element 144 is moved thereby to open the air inlet 142. There is a large difference in the water level between the interiors of the suction chamber 141 and the storage chamber 25 at the time of opening of the air inlet 142. This difference in the water level results in sudden drop of the water level in the suction chamber 141 upon opening of the air inlet 142, as shown in FIGS. 15 and 16. As a result, the water level in the suction chamber 141 becomes equal to the water level in the storage chamber 25. In this process, the suction device 140 vigorously sucks via the suction path 6 air in the toilet drain duct 3. Thus, the flush tank device 110 can vigorously suck air in the toilet drain duct 3 without increase in size of the suction device 140.

Furthermore, a time lag can be provided between start of toilet flushing and the opening of the air inlet 142. Accordingly, at the time of the opening of the air inlet 142, a predetermined amount of flush water flows in the toilet drain duct 3 as the result of flow of flush water from the storage chamber 25 into the rim water path 4, and the flush water flows at a predetermined flow rate. Consequently, when the air suction device 140 vigorously sucks air in the toilet drain duct 3, a siphon action can reliably be caused in the toilet drain duct 3.

Furthermore, since the difference between the water levels in the suction chamber 141 and the storage chamber 25 becomes smaller with lapse of time after the opening of the air inlet 142, the suction flow rate of the suction device 140 gradually reduces. This can prevent termination of siphon action in the toilet drain duct 3 due to an excessively large suction flow rate of the suction device 140 in the second half of toilet flushing, with the result that the siphon action can be continued.

Termination of Suction and Toilet Flushing

Flush water in the suction chamber 141 and the storage chamber 25 continues to flow through the outlet 22 into the rim water path 4 even after the water levels in the suction chamber 141 and the storage chamber 25 has become equal to each other. The float valve 21 closes the outlet 22 immediately before the water levels in the suction chamber 141 and the storage chamber 25 drop below the upper end of the communication hole 1410. Consequently, the suction device 140 ends air suction from the toilet drain duct 3. Furthermore, since the supply of flush water into the toilet drain duct 3 reduces, the siphon action in the toilet drain duct 3 is terminated. Thus, the suction device 140 continues to suck air in the toilet drain duct 3 until the predetermined amount of flush water flows through the outlet 22 into the rim water path 4 and the outlet 22 is closed by the float valve 21. The suction device 140 thus continues to suck air in the toilet drain duct 3 while the siphon action is caused, thereby reducing air in the toilet drain duct 3. Consequently, a flow of flush water is not easily blocked by remaining air, with the result that sewage or the like in toilet drain duct 3 can be conveyed successfully.

Accordingly, the flush toilet according to embodiment 2 can perform toilet flushing successfully.

Storage of Flush Water into Tank Body

The flush water is discharged through the water discharge pipe 31 of the ball tap 30 directly into the storage chamber 25 even after the outlet 22 has been closed by the float valve 21. Since the air inlet 142 of the suction device 140 is opened, flush water also flows through the communication hole 141C into the suction chamber 141. Accordingly, the water levels in the storage chamber 25 and the suction chamber 141 rise at the same rate. The float member 145 ascends according to the rise of water level in the storage chamber 25. When the float member 145 ascends, the air inlet 142 is open while the attracting member 147 and the valve element 144 is attracting each other. When the float member 145 ascends to such a level that the valve element 144 cannot be moved upward by the return portion 143B, the attracting member 147 and the valve element 144 cannot attract each other, whereupon the valve element 144 drops into the air inlet 142. Since the water level in the suction chamber 141 rises so as to be equal to the water level in the storage chamber 25 while the water level in the storage chamber 25 is increasing, the valve element 144 is pushed upward or displaced from the air inlet 142 by the pressure of air stored in the upper interior of the storage chamber 25. Thus, air in the suction chamber 141 flows to the suction path 6 side, and the water level in the suction chamber 141 is allowed to rise to the maximum water level LB1. The on-off valve 32 of the ball tap 30 is closed when the maximum water level LA1 is reached in the storage chamber 25 and the maximum water level LB1 is reached in the suction chamber 141. Furthermore, the attracting member 147 is raised to the maximum rise position by the bottom plate 146A of the holding portion 146. In this state, the attracting member 147 and the valve element 144 cannot attract each other, whereupon the air inlet 142 is closed by the valve element 144. Furthermore, flush water is supplied via a water supply path (not shown) branched from the ball tap 30, the overflow conduit 24 and the flush water path 5 into the rim water path 4 during the time between closure of the outlet 22 by the float valve 21 and closure of the on-off valve 32 of the ball tap 30, so that a water seal is formed in the toilet bowl 2. The flush toilet thus returns to the standby state for toilet flushing as shown in FIGS. 11 and 12.

When the tank body 20 is drained in a cold weather region, the bottom plate 146A of the holding portion 146 is placed on the top 141B since almost all flush water is discharged from the tank body 20. Accordingly, the attracting member 147 is pushed downward by the upper plate 146C of the holding portion 146 to such a position that the valve element 144 and the attracting member 147 cannot attract each other, whereupon the attracting member 147 is moved downward to the lowermost position.

Furthermore, since the valve element 144 and the attracting member 147 cannot attract each other, the valve element is moved to the position where the air inlet 142 is closed. Consequently, odor can be prevented from reverse flowing from the toilet drain duct 3 side when the tank body 20 is drained.

<Embodiment 3>

Figure 18:
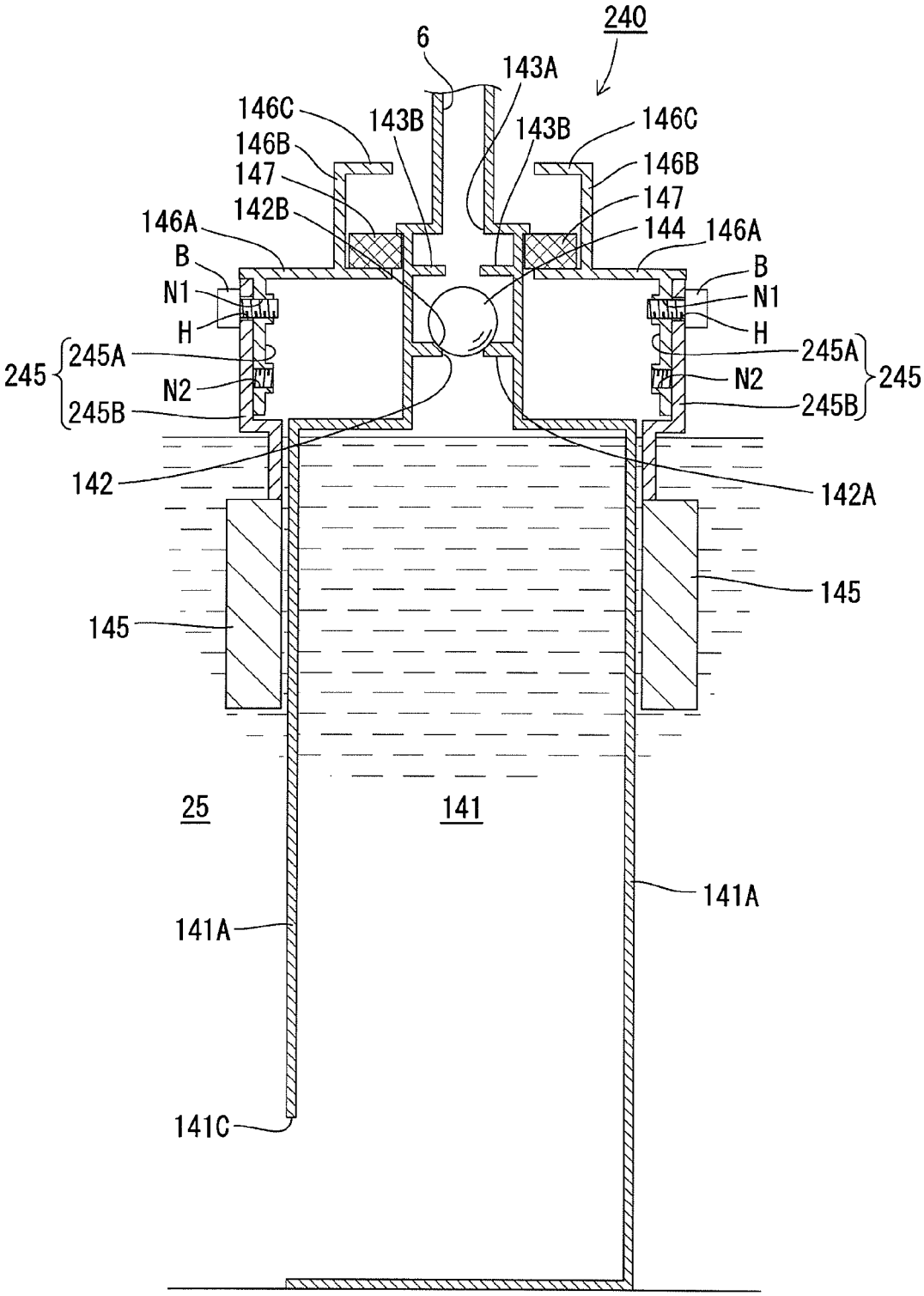
FIG. 18 is a sectional view of the air suction device according to embodiment 3, showing a standby state for toilet flushing.

The air suction device according to embodiment 3 includes the suction device 240 having a support member 245 with an adjustable length as shown in FIG. 18. The other construction of the flush toilet in embodiment 3 is the same as in embodiment 2. Identical parts in embodiment 3 are labeled by the same reference symbols as those in embodiment 2, and detailed description of these parts will be eliminated.

The support member 245 includes first support members 245A extending downward from a plurality of portions of the outer peripheral edge of the bottom plate 146A of the holding portion 146 respectively and a plurality of second support members 245B which are connected to the first support members 245A and have lower ends connected to the float member 145. The first support members 245A are provided with two vertically arranged bolt holes N1 and N2. Furthermore, the second support members 245B have upper ends further having through holes H through which bolts B are inserted.

When the upper bolt hole N1 or the lower bolt hole N2 is selected and the first and second support members 245A and 245B are connected together, the length of the support member 245 is adjustable in two steps. As a result, the water level in the storage chamber 25 at which the float member 145 descends can be changed. Consequently, the timing of start of air suction from toilet drain duct 3 by the suction device 240 can be changed. Accordingly, a suitable timing for start of the air suction by the air suction device can be obtained according to a type of the flushing toilet, with the result that the siphon action can reliably be caused in the toilet drain duct.

<Embodiment 4>

The air suction device according to embodiment 4 differs in the construction of the suction device 340 from embodiment 1 and the like as shown in FIGS. 19 to 23. Identical parts in embodiment 4 are labeled by the same reference symbols as those in embodiment 1, and detailed description of these parts will be eliminated.

The flush tank device 310 includes the tank body 20, the ball tap 30 serving as the water supply device, and the suction device 340. The suction device 340 includes the suction chamber 341, the guide 342, the float member 343 and the valve chest 344.

The suction chamber 341 includes a vertically extending cylindrical first side surface 341A dividing the interior of the tank body 20, and a first upper surface 341B connected to an upper end of the first side surface 341A. The first upper surface 341B has a centrally formed circular through opening 3413. The opening 341D has a rising wall 341E rising from an edge thereof. The first upper surface 3413 is located slightly above the maximum water level LA1 of flush water in the tank body 20 (the water level in standby state for toilet flushing). The first side surface 341A has a lower end formed with a laterally directed communication hole 341C. The suction chamber 341 and the interior of the tank body 20 outside the suction chamber 341 (herein, "storage chamber 25") communicate via the communication hole 341C with each other.

The guide 342 has an open upper end and a closed lower end and formed into a cylindrical shape. The guide 342 stands in the suction chamber 341 so as to be located below the opening 341D. The guide 342 has an inner diameter that is substantially equal to an opening diameter of the opening 341D. The guide 342 has a lower side surface formed with a first small through hole 342A. The guide 342 has an upper end 342T which is located lower than the maximum water level LB1 in the suction chamber 341.

The float member 343 includes a cylindrical member 343A having a closed upper end and a foam material 343B filling the interior of the cylindrical member 343A and having a buoyancy. The cylindrical member 343A has an outer shape that is formed so as to be smaller than an inner diameter of the guide 342 and an opening diameter of the opening 341D. The float member 343 has an upper portion formed with a hollow cavity 343C which is not filled with the foam material 343B. The cylindrical member 343A forming a side of the cavity 343C is formed with two vertically long vent holes 343D which are opposed to each other. The float member 343 has a flange 343E which is formed on an upper end peripheral edge thereof so as to outwardly extend. The flange 343E has a circular outer shape and is formed so as to be larger than the opening 341D. The seal material 343S is affixed to the underside of the flange 343E.

The float member 343 is inserted through the opening 341D and the upper end opening of the guide 342 into the guide 342. A slight space is defined between the outer surface of the float member 343 and the inner surface of the guide 342. The float member 343 ascends and descends while being guided by the inner surface of the guide 342. The float member 343 descends when the flush water in the suction chamber 341 is at a predetermined water level LB2 that is below the maximum water level LB1.

The valve chest 344 includes the second side surface 344A rising along the peripheral edge of the opening 341D and the second upper surface 344B connected to the upper end of the second side surface 344A. The second upper surface 344B has the air inlet 344C with a larger opening area and the second small hole 344D with a smaller opening area. The air inlet 344C is located higher than the water levels LA1 and LB1 in the standby state for toilet flushing. The seal material 344S is affixed to the underside of the peripheral edge of the air inlet 344C. The air inlet 344C and the second small hole 344D communicate via the suction path 6 with the toilet drain duct 3.

When the float member 343 ascends, the upper surface of the float member 343 abuts on the seal material 3445 affixed to the underside of the peripheral edge of the air inlet 344C. As a result, the float member 343 acts as an on-off valve and closes the air inlet 344C. In this state, the float member 343 occupies a highest position (hereinafter, "highest ascent position"). Furthermore, when the float member 343 descends, the seal material 343S affixed on the underside of flange 343E of the float member 343 abuts on an upper end surface of the rising wall 341E rising from the edge of the opening 341D. As a result, the opening 341D is closed by the float member 343. In this state, the float member 343 occupies a lowest position (hereinafter, "lowest descent position").

A vent passageway is formed between the highest ascent and lowest descent positions of the float member 343 by the vent holes 343D and the cavity 343C of the float member 343. The vent passageway communicates between the valve chest 344 and the suction chamber 341. Accordingly, air flowing through the air inlet 344C and the second small hole 344D into the valve chest 344 can successfully be caused to flow into the suction chamber 341. Consequently, the suction device 340 can successfully suck air in the toilet drain duct 3, with the result that the siphon action can successfully be caused in the toilet drain duct 3.

The following describes a toilet flushing step executed by the flush toilet constructed as described above.

Standby State

Figure 19:
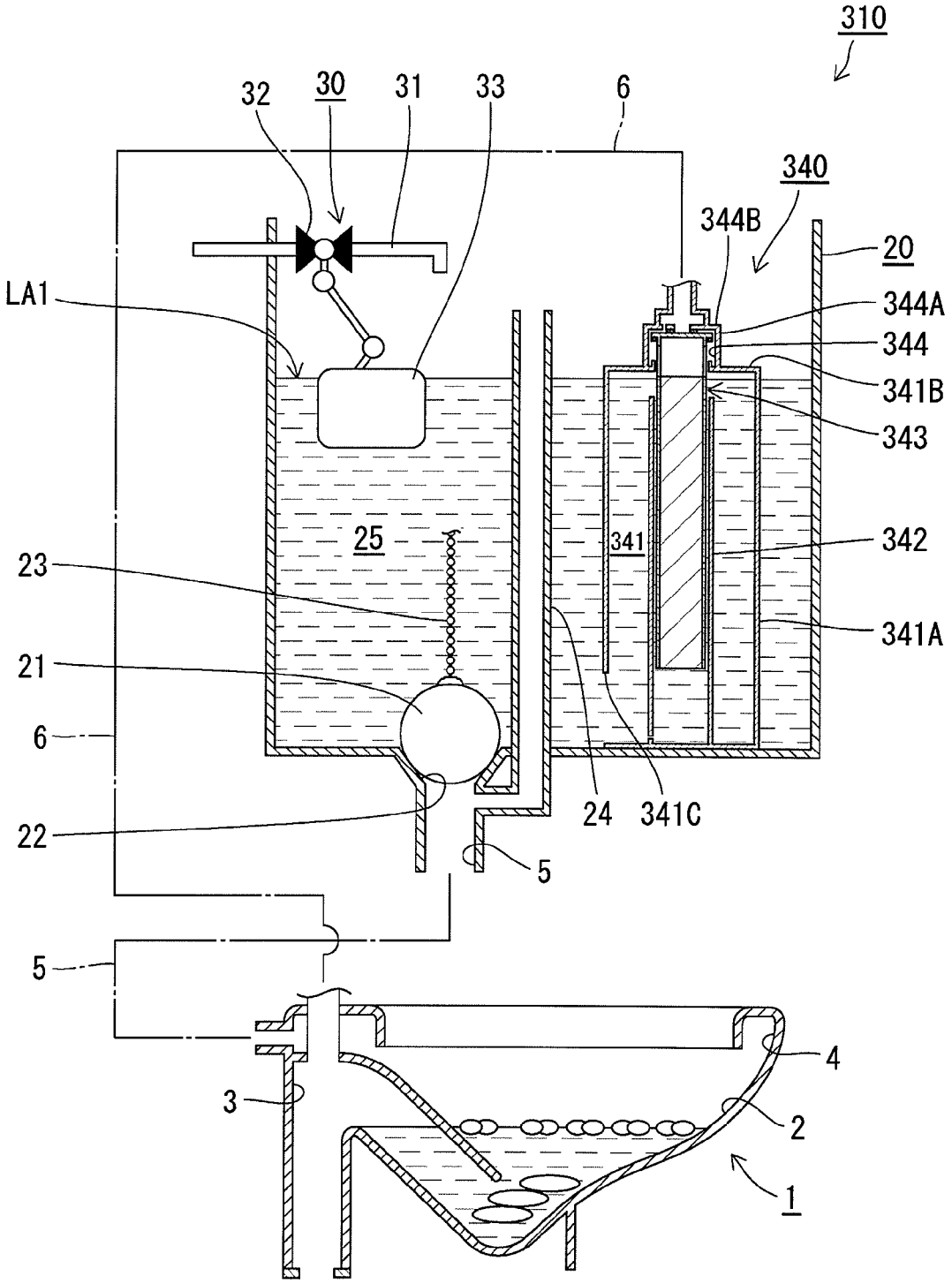
FIG. 19 is a schematic view of the flush toilet according to embodiment 4.
Figure 20:
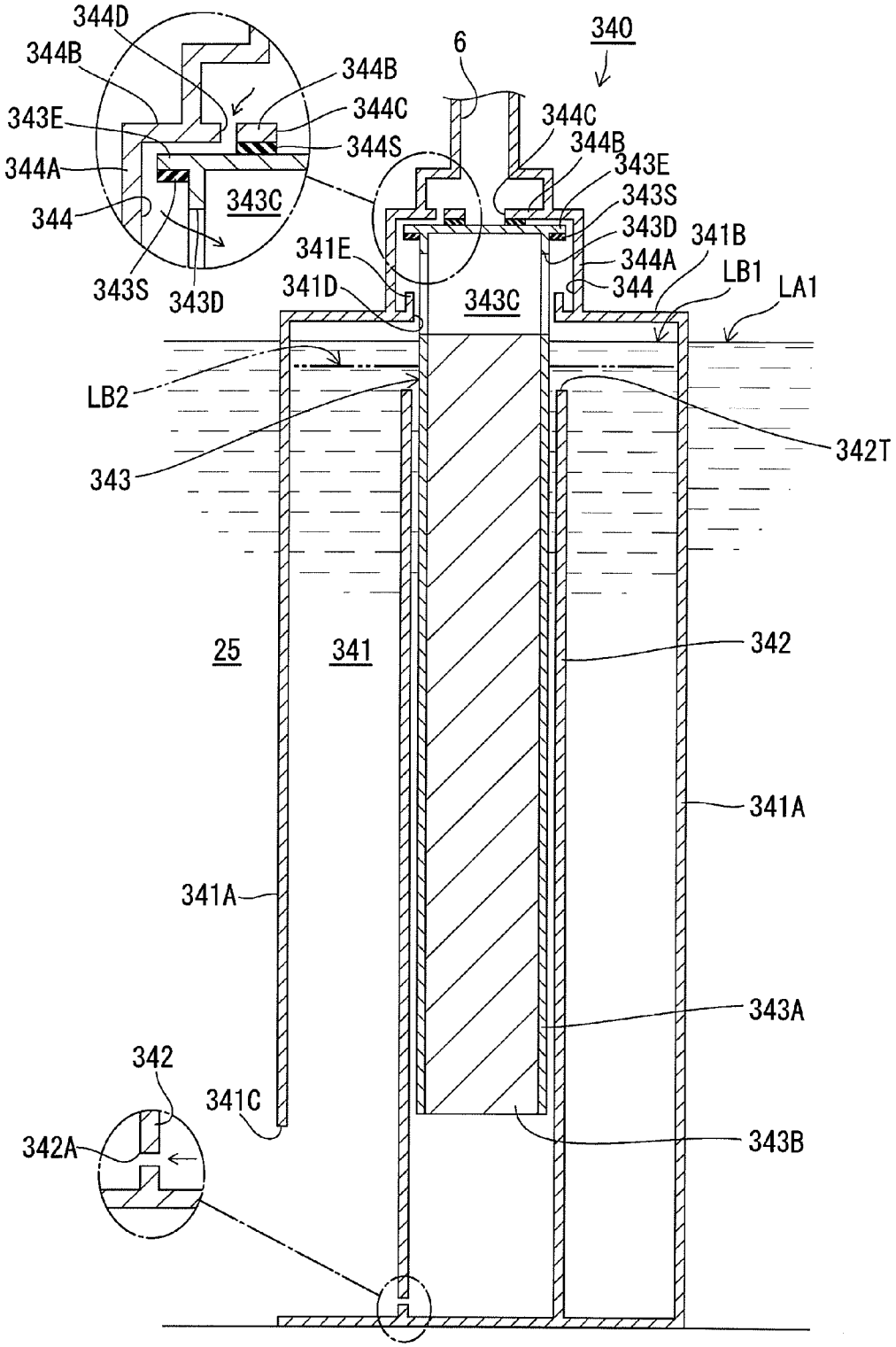
FIG. 20 is a sectional view of the air suction device, showing a standby state for toilet flushing.

In a standby state for toilet flushing, a predetermined amount of flush water is stored in the tank body 20 as shown in FIGS. 19 and 20. More specifically, the maximum water level LA1 is reached in the storage chamber 25 and the maximum water level LB1 is also reached in the suction chamber 341. Furthermore, the float member 343 occupies the uppermost ascent position thereby to close the air inlet 344C of the suction device 340.

Toilet Flushing Start

When the user operates the flush handle to raise via the ball chain 23 the float valve 21, the outlet 22 is opened so that flush water stored in the tank body 20 flows through the outlet 22 into the rim water path 4. In this case, the water level in the storage chamber 25 suddenly drops. On the other hand, since the air inlet 344C is closed by the float member 343, air is allowed to flow only through the second small hole 344D into the suction chamber 341. Accordingly, the water level in the suction chamber 341 starts to gradually drop slowly according to an amount of air flowing only through the second small hole 344D. The air inlet 344C is kept closed by the float member 343 until the water level in the suction chamber 341 drops to the set water level LB2 at which the float member 343 starts to descend.

Suction Start

Figure 21:
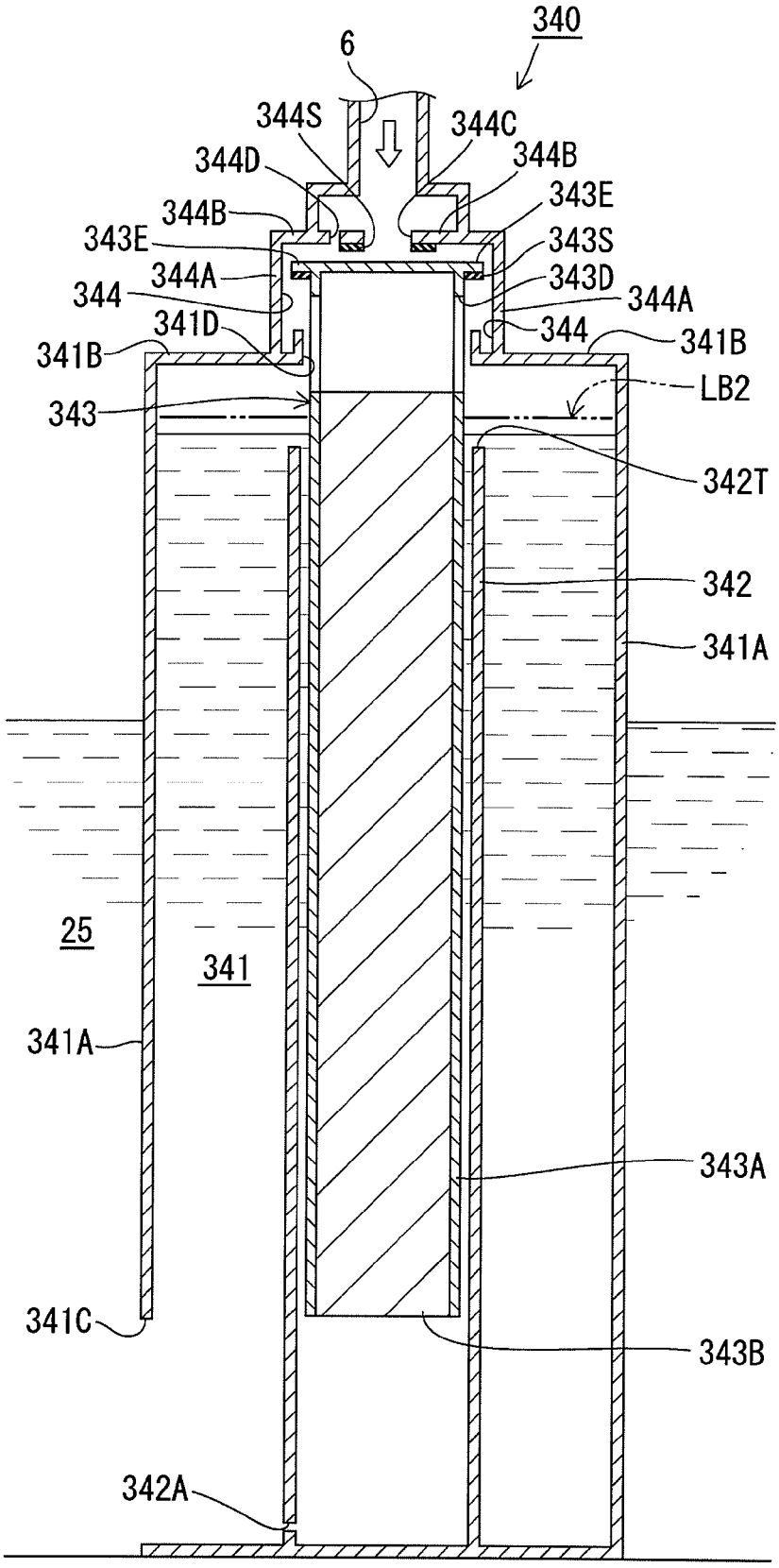
FIG. 21 is a sectional view of the air suction device, showing the state thereof immediately after air suction.
Figure 22:
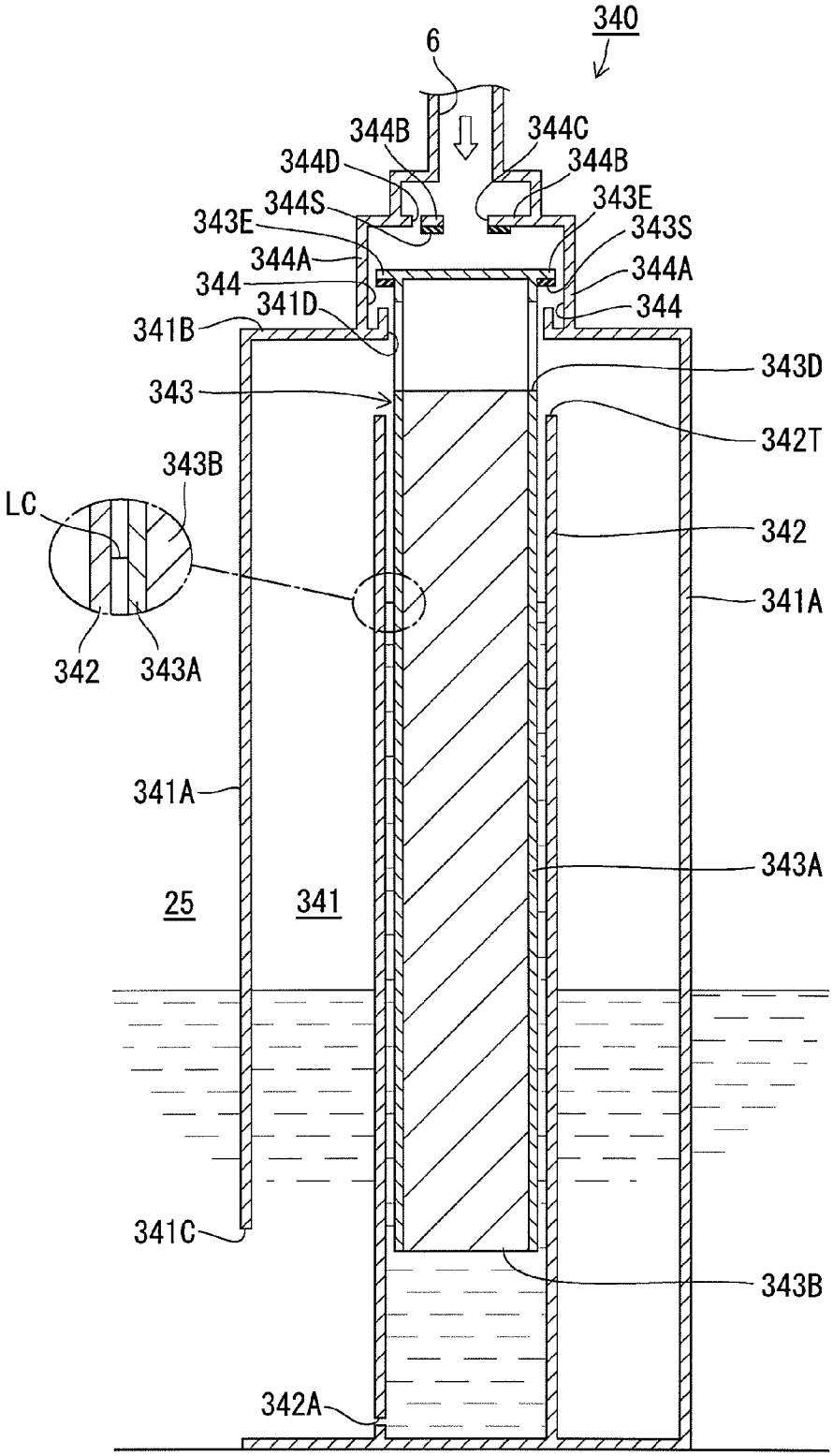
FIG. 22 is a sectional view of the air suction device, showing the suction state.

Subsequently, when the water level in the suction chamber 341 drops to or below the set water level LB2, the float member 343 starts to descend as shown in FIG. 21. The air inlet 344C is opened with descent of the float member 343. There is a large difference in the water level between the interiors of the suction chamber 341 and the storage chamber 25 at the time of opening of the air inlet 344C. This difference in the water level results in sudden drop of the water level in the suction chamber 341 upon opening of the air inlet 344C, whereupon the water level in the suction chamber 341 becomes equal to the water level in the storage chamber 25, as shown in FIG. 22. In this process, the suction device 340 vigorously sucks via the suction path 6 air in the toilet drain duct 3. Thus, the flush tank device 310 can vigorously suck air in the toilet drain duct 3 without increase in size of the suction device 340.

Furthermore, a time lag can be provided between start of toilet flushing and the opening of the air inlet 344C. Accordingly, at the time of the opening of the air inlet 344C, a predetermined amount of flush water flows in the toilet drain duct 3 as the result of flow of flush water from the storage chamber 25 into the rim water path 4, and the flush water flows at a predetermined flow rate. Consequently, when the air suction device 340 vigorously sucks air in the toilet drain duct 3, a siphon action can reliably be caused in the toilet drain duct 3.

When the water level in the suction chamber 341 drops below the upper end 342T of the guide 342, flush water in the guide 342 is discharged only through the first small hole 342A. Accordingly, the water level LC in the guide 342 drops more slowly than the water level in the interior of the suction chamber 341 outside the guide 342. This can increase a period of time from the opening of the air inlet 344C by the float member 343 to the closure of the opening 341D (until the float member descends to the lowermost descent position). Consequently, the suction device 340 can continue to suck air in the toilet drain duct 3 without closure of the opening 341D by the float member 343 until a predetermined amount of flush water flows through the outlet 22 of the tank body 20 into the rim water path 4 and the outlet 22 is closed by the float valve 21.

Since the difference between the water levels in the suction chamber 341 and the storage chamber 25 becomes smaller with lapse of time after the opening of the air inlet 344C, the suction flow rate of the suction device 340 gradually reduces. This can prevent termination of siphon action in the toilet drain duct 3 due to an excessively large suction flow rate of the suction device 340 in the second half of toilet flushing, with the result that the siphon action can be continued.

Termination of Suction and Toilet Flushing

Flush water in the suction chamber 341 and the storage chamber 25 continues to flow through the outlet 22 into the rim water path 4 even after the water levels in the suction chamber 341 and the storage chamber 25 has become equal to each other. The float valve 21 closes the outlet 22 immediately before the water levels in the suction chamber 341 and the storage chamber 25 drop below the upper end of the communication hole 341C. Consequently, the suction device 340 ends air suction from the toilet drain duct 3. Furthermore, since the supply of flush water into the toilet drain duct 3 reduces, the siphon action in the toilet drain duct 3 is terminated. Thus, the suction device 340 continues to suck air in the toilet drain duct 3 until the predetermined amount of flush water flows through the outlet 22 of the tank body 20 into the rim water path 4 and the outlet 22 is closed by the float valve 21. The suction device 340 thus continues to suck air in the toilet drain duct 3 while the siphon action is caused, thereby reducing air in the toilet drain duct 3. Consequently, a flow of flush water is not easily blocked by remaining air, with the result that sewage or the like in toilet drain duct 3 can be conveyed successfully.

Accordingly, the flush toilet according to embodiment 4 can perform toilet flushing successfully.

Storage of Flush Water into Tank Body

The flush water is discharged through the water discharge pipe 31 of the ball tap 30 directly into the storage chamber 25 even after the outlet 22 has been closed by the float valve 21. Since the air inlet 344C of the suction device 340 is opened, flush water also flows through the communication hole 341C into the suction chamber 341. Accordingly, the water levels in the storage chamber 25 and the suction chamber 341 rise at the same rate. Flush water also flows through the first small hole 342A into the guide 342, whereas flush water flows from the suction chamber 341 outside the guide 342 over the upper end 342T of the guide 342 into the guide 342. The float member 343 ascends with rise in the water level in the guide 342. The on-off valve 32 of the ball tap 30 is closed when the maximum water level LA1 is reached in the storage chamber 25 and the maximum water level LB1 is reached in the suction chamber 341. At the same time, the float member 343 reaches the uppermost ascent position, whereupon the air inlet 344C is closed. Furthermore, flush water is supplied via a water supply path (not shown) branched from the ball tap 30, the overflow conduit 24 and the flush water path 5 into the rim water path 4 during the time between closure of the outlet 22 by the float valve 21 and closure of the on-off valve 32 of the ball tap 30, so that a water seal is formed in the toilet bowl 2. The flush toilet thus returns to the standby state for toilet flushing as shown in FIGS. 19 and 20.

Figure 23:
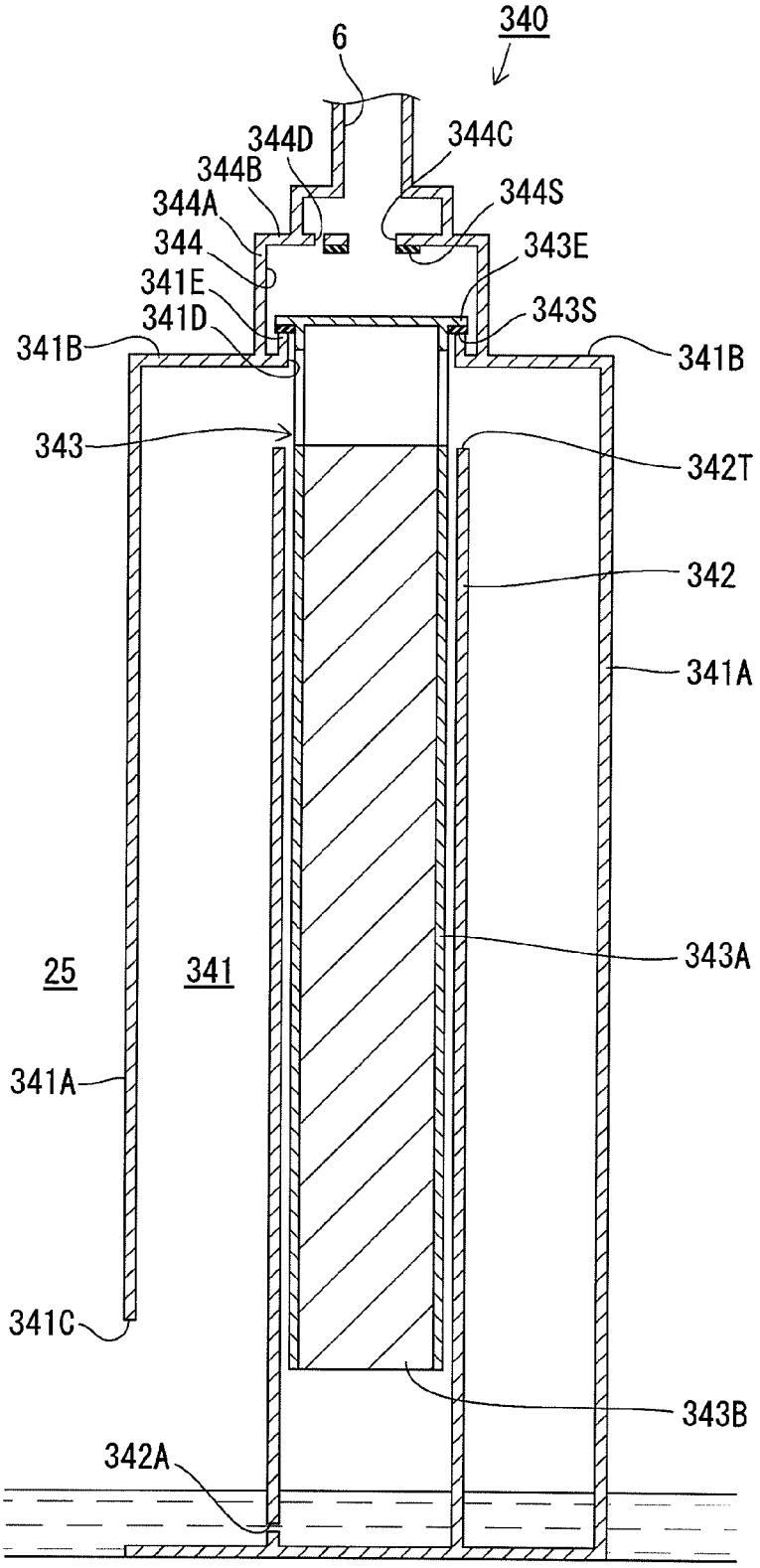
FIG. 23 is a sectional view of the air suction device, showing a drained state of the tank body.
Figure 24:
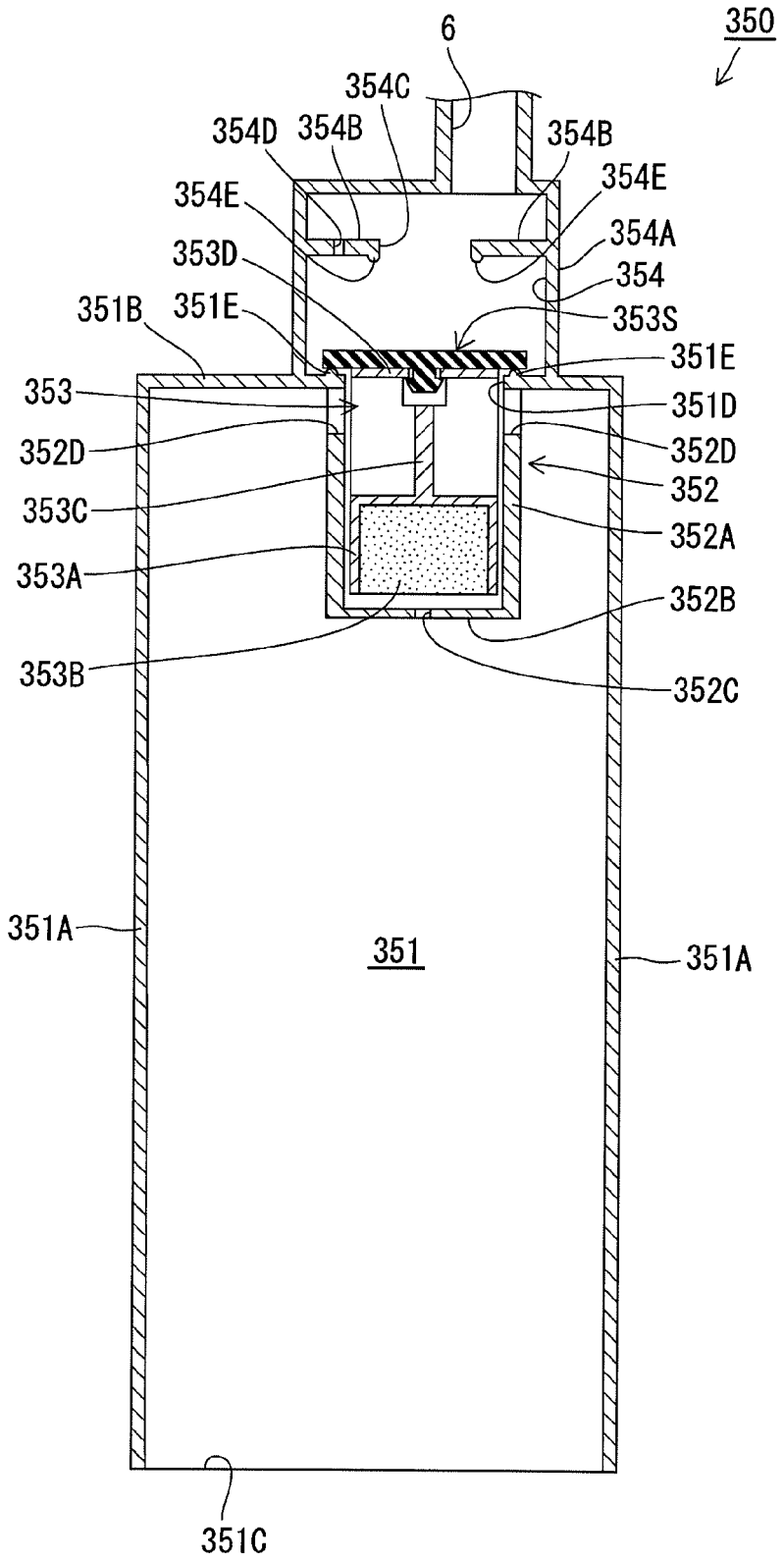
FIG. 24 is a sectional view of the air suction device according to embodiment 5.
Figure 25:
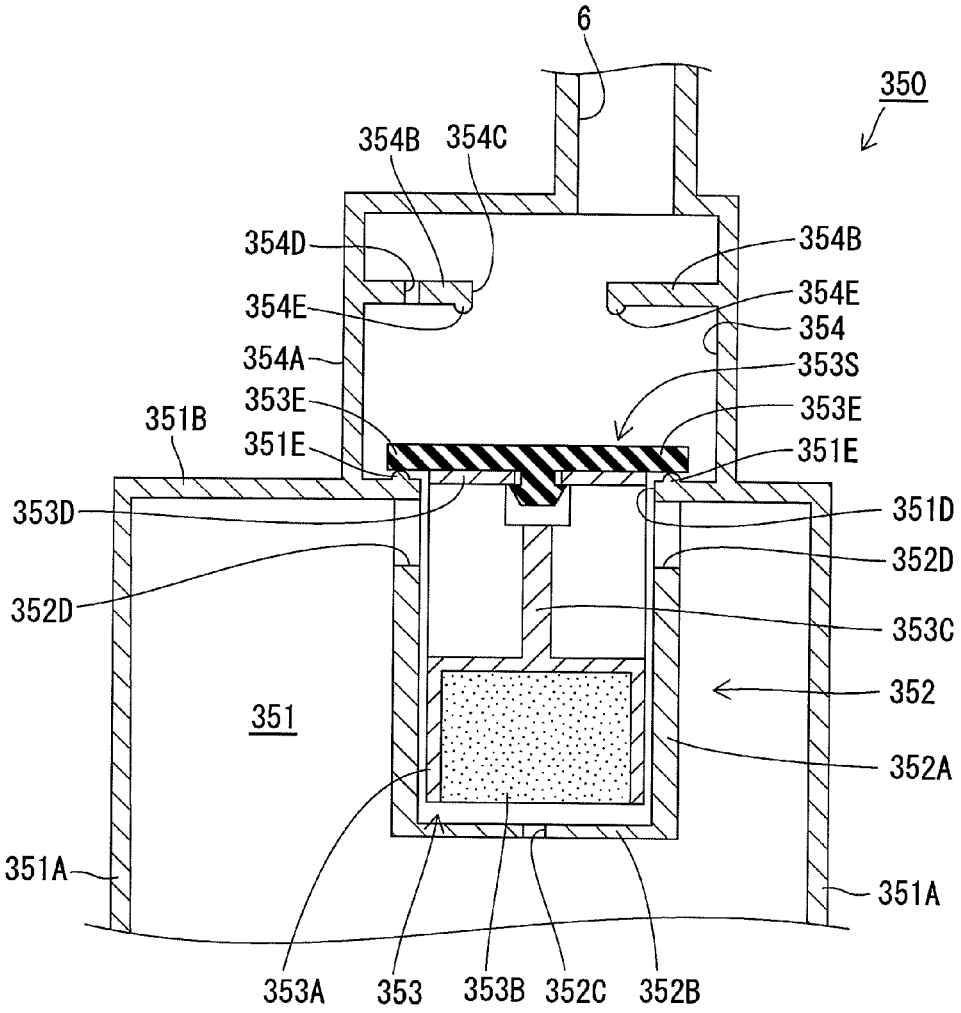
FIG. 25 is a sectional view of a relevant part of the air suction device.

When the tank body 20 is drained in a cold weather region, almost all flush water is discharged from the tank body 20, as shown in FIG. 23, whereupon the float member 343 descends to the lowermost descent position with the result the opening 341D is closed. Consequently, odor can be prevented from reverse flowing from the toilet drain duct 3 when the tank body 20 is drained.

<Embodiment 5>

The air suction device according to embodiment 5 differs in the construction of the suction device 350 from embodiment 4. Identical parts in embodiment 5 are labeled by the same reference symbols as those in embodiment 4, and detailed description of these parts will be eliminated.

The suction device includes the suction chamber 351, the guide 352, the float member 353 and the valve chest 354. The suction chamber 351 includes a vertically extending cylindrical first side surface 351A dividing the interior of the tank body 20, and a first upper surface 351B connected to an upper end of the first side surface 351A. The first upper surface 351B is formed with a circular through opening 351D. The first upper surface 351B has an upper surface formed with an upwardly projecting ring-shaped protrusion 351E. When the suction device 350 is disposed in the tank body 20, the first upper surface 351B is located slightly higher than the maximum water level (the water level in the standby state for toilet flushing) in the tank body 20. The first side surface 351A has a lower end which is downwardly open and forms the communication hole 351C. When the suction device 350 is disposed in the tank body 20, a space is defined between the bottom of the tank body 20 and the lower end of the first side surface 351A. Accordingly, the suction chamber 351 and the storage chamber 25 communicate with each other via the communication hole 351C.

The guide 352 includes a cylindrical side surface 352A with an open upper end and a bottom 352B which is connected to the lower end of the side surface 352A and formed with a first small through hole 352C. The upper end of the side surface 352A is connected to a peripheral edge underside of an opening 351D formed through an upper surface 351B of the suction chamber 351. The side surface 352A has an upper end formed with a plurality of vent holes 352D. When the suction device 350 is disposed in the tank body 20, lower ends of the vent holes 352D are located lower than the maximum water level in the suction chamber 351.

Accordingly, when flush water is supplied from the water supply device 30 into the flush tank 20 and the water level in the suction chamber 351 rises, flush water flows through the first small hole 352C and the vent holes 352D into the guide 352.

The float member 353 includes a cylindrical portion 353A which is filled with a foam material 353B with buoyancy and has a closed upper end, a disc-shaped upper surface 353D, a connecting potion 353C connecting an upper end surface of the cylindrical portion 353A and a lower end surface of the upper surface 353D, and a disc-shaped seal member 353S connected to an upper surface of the upper surface 353D. The connecting portion 353C has a cross-shaped horizontal section. The cylindrical portion 353A, the upper surface 353D and the connecting portion 353C are inserted through the opening 351D into the guide 352. The seal member 353S has an outer shape larger than an opening diameter of the opening 351D thereby to be formed into the flange 353E. The float member 353 descends when flush water in the suction chamber 351 is at or below a predetermined water level lower than the maximum water level in the suction chamber 351. The float member 353 ascends or descends with change in the water level in the guide 352. When the float member 353 descends to the lowermost descent position, the underside of the flange 353E abuts on the upper surface of the protrusion 351E, so that the seal member 353S closes the opening 351D.

The valve chest 354 includes the second side surface 354A rising along the peripheral edge of the opening 351D and the second upper surface 354B connected to the inner surface of the second side surface 354A. The second upper surface 354B has the air inlet 354C with a larger opening area and the second small hole 354D with a smaller opening area. The air inlet 354C has an opening diameter that is formed so as to be smaller than an outer shape of the seal member 353S. The second upper surface 354B has an underside formed with a ring-shaped protrusion 354E projecting below a peripheral edge of the air inlet 345C. The air inlet 354C and the second small hole 354D communicate via the suction path 6 with the toilet drain duct 3. When the float member 353 ascends, the upper surface of the seal member 353S abuts on the underside of the protrusion 354E. As a result, the float member 353 acts as an on-off valve and the air inlet 354C is closed by the seal member 353S. In this state, the float member 353 occupies the uppermost ascent position.

When the float member 353 is located between the uppermost ascent position and the lowermost descent position, a vent passageway communicating between the valve chest 354 and the suction chamber 351 is formed by the connecting portion 353C of the float member 353 and the vent hole 352D formed through the side surface 352A of the guide 352. Accordingly, air flowing through the air inlet 354C and the second small hole 354D into the valve chest 354 can successfully be caused to flow into the suction chamber 351. Consequently, the suction device 350 can successfully suck air in the toilet drain duct 3 and accordingly, the siphon action can successfully be caused in the toilet drain duct 3.

The following describes a toilet flushing step executed by the flush toilet provided with the flush tank device with the suction device 350 constructed as described above.

Standby State

A predetermined mount of flush water is stored in the tank body 20 in the flush toilet before start of toilet flushing. Accordingly, the float member 353 is located at the uppermost ascent position, and the air inlet 354C of the suction device 350 is closed by the seal member 353S of the float member 353.

Toilet Flushing Start

When the user operates the flush handle to raise via the ball chain 23 the float valve 21, the outlet 22 is opened so that flush water stored in the tank body 20 flows through the outlet 22 into the rim water path 4. In this case, the water level in the storage chamber 25 suddenly drops. On the other hand, since the air inlet 354C is closed by the seal member 353S of the float member 353, air is allowed to flow only through the second small hole 354D into the suction chamber 351. Accordingly, the water level in the suction chamber 351 starts to gradually drop slowly according to an amount of air flowing through the second small hole 354D. The air inlet 354C is kept closed by the seal member 353S of the float member 353 until the float member 353 starts to descend.

Suction Start

Subsequently, when flush water in the guide 352 flows through the first small hole 352C and accordingly, the water level in the guide 352 drops, the float member 353 starts to descend. The air inlet 354C is opened with descent of the float member 353. There is a large difference in the water level between the interiors of the suction chamber 351 and the storage chamber 25 at the time of opening of the air inlet 354C. This difference in the water level results in sudden drop of the water level in the suction chamber 351 upon opening of the air inlet 354C, whereupon the water level in the suction chamber 351 becomes equal to the water level in the storage chamber 25. In this process, the suction device 350 vigorously sucks via the suction path 6 air in the toilet drain duct 3. Thus, the flush tank device can vigorously suck air in the toilet drain duct 3 without increase in size of the suction device 350.

Furthermore, a time lag can be provided between start of toilet flushing and the opening of the air inlet 354C.

Accordingly, at the time of the opening of the air inlet 354C, a predetermined amount of flush water flows in the toilet drain duct 3 as the result of flow of flush water from the storage chamber 25 into the rim water path 4, and the flush water flows at a predetermined flow rate. Consequently, when the air suction device 350 vigorously sucks air in the toilet drain duct 3, a siphon action can reliably be caused in the toilet drain duct 3.

Furthermore, since flush water in the guide 352 is discharged only through the first small hole 352C, the water level in the guide 352 drops more slowly than the water level in the interior of the suction chamber 351 outside the guide 352. This can increase a period of time from the opening of the air inlet 354C by the seal member 353S of the float member 353 to the closure of the opening 351D. Consequently, the suction device 350 can continue to suck air in the toilet drain duct 3 without closure of the opening 351D by the seal member 353S of the float member 353 until a predetermined amount of flush water flows through the outlet 22 of the tank body 20 into the rim water path 4 and the outlet 22 is closed by the float valve 21.

Since the difference between the water levels in the suction chamber 351 and the storage chamber 25 becomes smaller with lapse of time after the opening of the air inlet 354C, the suction flow rate of the suction device 350 gradually reduces. This can prevent termination of siphon action in the toilet drain duct 3 due to an excessively large suction flow rate of the suction device 350 in the second half of toilet flushing, with the result that the siphon action can be continued.

Termination of Suction and Toilet Flushing

The float valve 21 closes the outlet 22 immediately before the water levels in the suction chamber 351 and the storage chamber 25 drop below the communication hole 351C. Consequently, the suction device 350 ends air suction from the toilet drain duct 3. Furthermore, since the supply of flush water into the toilet drain duct 3 reduces, the siphon action in the toilet drain duct 3 is terminated. Thus, the suction device 350 continues to suck air in the toilet drain duct 3 until the predetermined amount of flush water flows through the outlet 22 of the tank body 20 into the rim water path 4 and the outlet 22 is closed by the float valve 21. The suction device 350 thus continues to suck air in the toilet drain duct 3 while the siphon action is caused, thereby reducing air in the toilet drain duct 3. Consequently, a flow of flush water is not easily blocked by remaining air, with the result that sewage or the like in toilet drain duct 3 can be conveyed successfully.

Accordingly, the flush toilet according to embodiment 5 can also perform toilet flushing successfully.

The flush water is discharged through the water discharge pipe 31 of the ball tap 30 directly into the storage chamber 25 even after the outlet 22 has been closed by the float valve 21. Since the air inlet 354C of the suction device 350 is opened, flush water also flows through the communication hole 351C into the suction chamber 351. Accordingly, the water levels in the storage chamber 25 and the suction chamber 351 rise at the same rate. Flush water also flows through the first small hole 352C and the vent hole 352D into the guide 352. The float member 353 ascends with rise in the water level in the guide 352. The on-off valve 32 of the ball tap 30 is closed when the maximum water levels are reached in the storage chamber 25 and the suction chamber 351 respectively. At the same time, the float member 353 reaches the uppermost ascent position, whereupon the air inlet 354C is closed. Furthermore, flush water is supplied via a water supply path (not shown) branched from the ball tap 30, the overflow conduit 24 and the flush water path 5 into the rim water path 4 during the time between closure of the outlet 22 by the float valve 21 and closure of the on-off valve 32 of the ball tap 30, so that a water seal is formed in the toilet bowl 2. The flush toilet thus ends toilet flushing and returns to the standby state for toilet flushing.

When the tank body 20 is drained in a cold weather region, almost all flush water is discharged from the tank body 20, whereupon the float member 353 descends to the lowermost descent position with the result that the opening 351D is closed. Consequently, odor can be prevented from reverse flowing from the toilet drain duct 3 when the tank body 20 is drained.

The invention should not be limited by the embodiments 1 to 5 described above with reference to the drawings, but the following embodiments also fall within the scope of the invention.

(1) The on-off valve may not have a second valve element although the on-off valve has the second valve element in embodiment 1.

(2) The float member and the on-off valve may be formed integrally with each other although the float member and the on-off valve are formed independent of each other in embodiment 1.

(3) Although the protrusion is formed on the upper end of the float member and the recess is formed in the lower end of the on-off valve in embodiment 1, the protrusion and the recess may not be provided.

(4) Although the float valve element is provided for closing the lower opening of the guide member in embodiment 1, the lower opening may be configured so that flush water is easy to flow from the interior of the guide member to the suction chamber outside the guide member and, conversely, so that flush water is hard to flow the suction chamber outside the guide member into the interior of the guide member.

(5) Although the valve element is made of iron and the attracting member is made of permanent magnet in embodiments 2 and 3, the valve element may be made of permanent magnet and the attracting member may be made of iron, instead. (6) Although the valve element is a spherical body in embodiments 2 and 3, the valve element may be disc-shaped, conical or flapper-shaped.

(7) Although the length of the support member is adjustable in two steps in embodiment 3, the support member may be configured so that the length thereof is adjustable in multiple of steps or continuously.

(8) Although the float member is made by filling the interior of the cylindrical member (the cylindrical portion) with a foam material in embodiments 4 and 5, the float member may be filled with air so that a hermetic chamber is formed and has buoyancy.

(9) Although the float member is formed with the vent passageway in embodiments 4 and 5, the vent passageway may not be formed. In this case, air may be caused to flow between the valve chest and the suction chamber by making use of a space between the float member and the opening.

(10) Although the opening in the upper surface forming the suction chamber is closed by the flange of the float member or the seal member in embodiments 4 and 5, the flush tank device may be configured so that the opening is not closed.

(11) Although the suction chamber and the tank body are formed independent of each other in embodiments 1 to 5, the suction chamber may be formed integrally with the tank body.

(12) Although the side surface of the suction chamber is formed into the cylindrical shape in embodiments 2 to 5, the side surface of the suction chamber may not be limited to the cylindrical shape.

INDUSTRIAL APPLICABILITY

The present invention is applicable to a flush toilet having a flush tank device.

EXPLANATION OF REFERENCE SYMBOLS

1 . . . toilet body
2 . . . toilet bowl
3 . . . toilet drain duct
6 . . . suction path
10, 110, 310 . . . flush tank device
20 . . . tank body
30 . . . ball tap (water supply device)
40, 140, 240, 340, 350 . . . suction device
41, 141, 341, 351 . . . suction chamber
43, 145, 343, 353 . . . float member
43C . . . protrusion
44, 144, 343, 353 . . . on-off valve (144 . . . valve element)
44A . . . shaft
44B . . . first valve element
44C . . . second valve element
44D . . . recess
45 . . . guide member
45A . . . upper opening
45B . . . lower opening
46 . . . float valve element
47A, 142, 344C, 354C . . . air inlet
47B . . . guide path
47C . . . upper end opening
143, 344, 354 . . . valve chest
146 . . . holding portion
147 . . . attracting member
342, 352 . . . guide

The invention claimed is:

1. An air suction device for use with a flush toilet that has a tank body for storing flush water used to flush a toilet body having a toilet bowl and a toilet drain duct communicating with a downstream side of the toilet bowl and a water supply device for supplying flush water into the tank body, the air suction device being configured to suction air from the toilet drain duct, the air suction device comprising:

a suction chamber formed as to divide an interior of the tank body and extending in an up-down direction and having a lower end that has an opening for communicating with an interior of the tank body;

a float member disposed in the suction chamber and having a set buoyancy;

an on-off valve that closes an air inlet when the float member is raised to a predetermined raised position, thereby preventing air flow from a toilet drain duct side into the suction chamber, the air inlet being located higher than a water level in a toilet flushing standby mode and configured for communication of air between the suction chamber and the toilet drain duct side, the on-off valve opening the air inlet to allow air to flow from the toilet drain duct side into the suction chamber when the flush water in the tank body outside the suction chamber drops to or below a set water level such that the float member is lowered from the raised position.

2. The air suction device according to claim 1, wherein;

the on-off valve has a shaft which is reciprocally moved in the vertical direction within the air inlet, and a first valve element connected to a lower end of the shaft and abutting on a peripheral edge of the air inlet; and the float member is formed independent of the on-off valve and, when raised, has an upper end that abuts a lower end of the on-off valve thereby to raise the on-off valve.

3. The flush tank air suction device according to claim 2, further comprising a guide member provided in the suction chamber and housing the float member so that the float member is reciprocally moved in the vertical direction, the guide member having an upper opening formed in an upper end thereof and a lower opening formed in a lower end thereof, and a float valve element provided in the lower opening of the guide member so as to ascend thereby to close the lower opening of the guide member when a water level in the suction chamber is raised from below the lower end of the guide member.

4. The air suction device flush tank device according to claim 2, wherein the float member has a protrusion formed on an upper end thereof and the on-off valve has a recess which is formed in a lower end thereof and in which recess the protrusion extends when raising the on-off valve.

5. The air suction device according to claim 4, wherein: the air inlet has a guide path extending vertically upward; and the shaft of the on-off valve is formed to be longer than the guide path and guided by the guide path when reciprocally moved in the vertical direction; and the on-off valve has a second valve element which is connected to an upper end of the shaft and abuts on a peripheral edge of an upper end opening of the guide path when the float member descends below a set descent position, thereby preventing air from flowing from the toilet drain duct side into the suction chamber.

6. The air suction device according to claim 4, further comprising a guide member provided in the suction chamber and housing the float member so that the float member is reciprocally moved in the vertical direction, the guide member having an upper opening formed in an upper end thereof and a lower opening formed in a lower end thereof, and a float valve element provided in the lower opening of the guide member so as to ascend thereby to close the lower opening of the guide member when a water level in the suction chamber is raised from below the lower end of the guide member.

7. The air suction device flush tank device according to claim 2, wherein:

the air inlet has a guide path extending vertically upward; and the shaft of the on-off valve is formed to be longer than the guide path and guided by the guide path when reciprocally moved in the vertical direction; and the on-off valve has a second valve element which is connected to an upper end of the shaft and abuts on a peripheral edge of an upper end opening of the guide path when the float member descends below a set descent position, thereby preventing air from flowing from the toilet drain duct side into the suction chamber.

8. The air suction device according to claim 1, further comprising a guide member provided in the suction chamber and housing the float member so that the float member is reciprocally moved in the vertical direction, the guide member having an upper opening formed in an upper end thereof and a lower opening formed in a lower end thereof, and a float valve element provided in the lower opening of the guide member so as to ascend thereby to close the lower opening of the guide member when a water level in the suction chamber is raised from below the lower end of the guide member.

9. The air suction device of claim 1 wherein the suction chamber communicates via an air suction path with the toilet drain duct, and the suction chamber is configured such that flush water stored in the suction chamber is released at a lower end of the suction chamber for supply to an outlet of the tank body that communicates with a rim water path provided along an inner peripheral edge of an upper end opening of the toilet bowl.

10. The air suction device of claim 9 wherein the suction chamber is configured such that flush water stored in the suction chamber adds to flush water being supplied to the toilet bowl.

11. A flush toilet comprising: a toilet body having a toilet bowl and a toilet drain duct communicating with a downstream side of the toilet bowl; and the air suction device defined by claim 1, wherein the suction chamber communicates via an air suction path with the toilet drain duct, and the tank body has an outlet communicating with a rim water path provided along an inner peripheral edge of an upper end opening of the toilet bowl.

12. An air suction device for use with a flush toilet that has a tank body for storing flush water used to flush a toilet body having a toilet bowl and a toilet drain duct communicating with a downstream side of the toilet bowl and a water supply device for supplying flush water into the tank body, the air suction device being configured to suction air from the toilet drain duct, the air suction device comprising:

a suction chamber formed as to divide an interior of the tank body and extending in an up-down direction and having a lower end that has an opening for communicating with an interior of the tank body;

an on-off valve selectively closing and opening an air inlet that is located higher than a water level in a toilet flushing standby mode and which air inlet is configured for communication of air between the suction chamber and a toilet drain duct side, the on-off valve, when in a closed state, preventing air flow through the air inlet from a toilet drain duct side into the suction chamber, the on-off valve, when in an open state, allowing air flow through the air inlet from the toilet drain duct side into the suction chamber, and wherein the air suction device further includes a valve chest which is formed so as to extend upward from the air inlet and communicates with the toilet drain duct, the valve chest housing the on-off valve; and a float member disposed such that the float member descends when flush water in the tank body is at or below a set water level lower than the water level in the toilet flushing standby mode; and a holding portion disposed as to move upward and downward along the valve chest in conjunction with ascent and descent of the float member, the holding portion holding an attracting member which attracts the on-off valve or vice versa when a distance therebetween is within a set range, thereby adjusting a state of the on-off valve.

13. A flush toilet comprising: a toilet body having a toilet bowl and a toilet drain duct communicating with a downstream side of the toilet bowl; and the air suction device defined by claim 12, wherein the suction chamber communicates via an air suction path with the toilet drain duct, and the tank body has an outlet communicating with a rim water path provided along an inner peripheral edge of an upper end opening of the toilet bowl.

14. The air suction device of claim 12 wherein the attracting member, when within the set range, adjusts the on-off valve into the open state.

15. The air suction device of claim 12 wherein the suction chamber is positioned such that the float member is outside the suction chamber.

16. The air suction device of claim 12 wherein the valve chest is formed so as to extend upward from a peripheral edge of the air inlet.

17. An air suction device for use with a flush toilet that has a tank body for storing flush water used to flush a toilet body having a toilet bowl and a toilet drain duct communicating with a downstream side of the toilet bowl, a water supply device supplying flush water into the tank body, the air suction device being configured to suction air from the toilet drain duct, the air suction device comprising:

a suction chamber formed as to divide an interior of the tank body and extending in an up-down direction and having a lower end that has an opening for communicating with the interior of the tank body;

an on-off valve selectively closing and opening an air inlet that is located higher than a water level in a toilet flushing standby mode and which air inlet is configured for communication of air between the suction chamber and a toilet drain duct side, the on-off valve, when in a closed state, preventing air flow through the air inlet from a toilet drain duct side into the suction chamber, the on-off valve, when in an open state, allowing air flow through the air inlet from the toilet drain duct side into the suction chamber, and wherein the suction chamber is defined by a first side surface dividing the interior of the tank body and a first upper surface connected to an upper end of the first side surface and having a through opening, the suction chamber being provided with a communicating hole; said air suction device further comprising;

a guide located below the through opening of the first upper surface in the suction chamber and having a first hole formed through a lower side or a bottom thereof, the guide having an open upper end;

a float member provided within the suction chamber and extending within the guide, the float member descending when the flush water is at or below a set water level lower than a maximum water level of the flush water in the suction chamber; and a valve chest defined by a second side surface rising above the opening of the first upper surface of the suction chamber and a second upper surface connected to the second side surface and having the air inlet and a second hole both formed in the second upper surface, wherein the air inlet and the second hole communicate via an air suction path with the toilet drain duct, and the air inlet is closed by the float member acting as the on-off valve when the float member ascends.

18. A flush toilet comprising: a toilet body having a toilet bowl and a toilet drain duct communicating with a downstream side of the toilet bowl, a tank body for storing flush water for use in flushing the toilet body; and the air suction-device defined by claim 17, wherein the suction chamber communicates via an air suction path with the toilet drain duct, and the tank body has an outlet communicating with a rim water path provided along an inner peripheral edge of an upper end opening of the toilet bowl.

19. The air suction device of claim 17 wherein the second hole has a diameter that is smaller than a diameter of the air inlet.

20. The air suction device of claim 17 wherein the first hole has a diameter that is smaller than the diameter of the air inlet.

* * * * *